US011597061B2

(12) United States Patent
Ellice et al.

(10) Patent No.: US 11,597,061 B2
(45) Date of Patent: Mar. 7, 2023

(54) HIGH TORQUE IMPACT TOOL

(71) Applicant: MILWAUKEE ELECTRIC TOOL CORPORATION, Brookfield, WI (US)

(72) Inventors: Joseph H. Ellice, Greenfield, WI (US); Jacob P. Schneider, Madison, WI (US); Andrew J. Weber, Cudahy, WI (US); FengKun Lu, Dongguan (CN); Guang Hu, Dongguan (CN)

(73) Assignee: MILWAUKEE ELECTRIC TOOL CORPORATION, Brookfield, WI (US)

( * ) Notice: Subject to any disclaimer, the term of this patent is extended or adjusted under 35 U.S.C. 154(b) by 322 days.

(21) Appl. No.: 16/703,970

(22) Filed: Dec. 5, 2019

(65) Prior Publication Data

US 2020/0180124 A1 Jun. 11, 2020

Related U.S. Application Data

(60) Provisional application No. 62/777,501, filed on Dec. 10, 2018.

(51) Int. Cl.
*B25B 21/02* (2006.01)
*B25B 23/16* (2006.01)

(52) U.S. Cl.
CPC ..... *B25B 21/02* (2013.01); *B25B 23/16* (2013.01)

(58) Field of Classification Search
CPC ..... B25B 21/02; B25B 21/00; B25B 21/026; B25B 23/16; B25B 23/147;
(Continued)

(56) References Cited

U.S. PATENT DOCUMENTS 2,373,664 A * 4/1945 Emery ..... B25B 21/02 173/93.5
2,373,667 A * 4/1945 Emery ..... B25B 23/1405 173/13
(Continued)

FOREIGN PATENT DOCUMENTS

CN 101186034 A 5/2008
CN 202684816 U 1/2013
(Continued)

OTHER PUBLICATIONS

Ingersoll Rand, "Air Impact Wrench 2850MAX and 2850MAX-6" Product Information, Edition 3, Feb. 2018, 32 pages.
(Continued)

*Primary Examiner* — Dariush Seif
(74) *Attorney, Agent, or Firm* — Michael Best & Friedrich LLP

(57) ABSTRACT

An impact tool includes a housing extending along a longitudinal axis. The housing includes a motor housing portion, a first handle extending from the motor housing portion, and a front housing coupled to the motor housing portion opposite the first handle. The impact tool also includes a motor supported within the motor housing portion, an anvil extending from the front housing, an impact mechanism supported within the front housing, and an auxiliary handle assembly. The auxiliary handle assembly includes a mount coupled to the housing, an auxiliary handle coupled to the mount and spaced from the first handle, and an adjustment mechanism. Loosening the adjustment mechanism permits rotation of the auxiliary handle assembly about the longitudinal axis relative to the housing, and tightening the adjustment mechanism secures the auxiliary handle assembly in a selected rotational position.

28 Claims, 18 Drawing Sheets

(58) Field of Classification Search
CPC ..... B25B 23/1475; B25B 23/1453; B25B 23/1405; B25B 19/00; B25D 11/04; B25D 11/066; B25D 16/00; B25D 16/003; B25D 16/006; B25D 2216/0023; B25F 5/026
USPC ..... 173/117, 90, 91, 93, 94, 128
See application file for complete search history.

(56) References Cited

U.S. PATENT DOCUMENTS 2,564,224 A * 8/1951 Mitchell ..... F16D 43/06 81/466
2,825,436 A * 3/1958 Amtsberg ..... B25B 21/026 173/93
2,881,884 A * 4/1959 Amtsberg ..... B25B 21/026 173/93.6
2,973,071 A * 2/1961 Sturrock ..... B25B 21/026 173/93.6
3,068,973 A * 12/1962 Maurer ..... B25B 21/02 477/166
3,070,201 A * 12/1962 Spyridakis ..... B25B 21/026 173/93
3,156,334 A * 11/1964 Hoza ..... B25B 21/02 192/113.1
3,250,153 A * 5/1966 Purkey ..... B25H 1/0057 408/100
3,352,368 A * 11/1967 Maffey, Jr. ..... B25B 21/00 D8/68
3,362,486 A * 1/1968 Alajouanine ..... B25B 23/1453 173/93.5
3,369,615 A * 2/1968 Maffey, Jr. ..... B25F 5/02 173/93.6
3,606,931 A * 9/1971 Karden ..... B25B 21/026 173/93.5
3,648,784 A * 3/1972 Schoeps ..... B25B 21/026 173/93.5
3,804,180 A * 4/1974 Gelfand ..... B25B 21/02 173/15
4,002,212 A * 1/1977 Schoeps ..... B25B 21/02 173/93.5
4,276,675 A * 7/1981 Pioch ..... B25F 5/026 74/544
4,314,782 A * 2/1982 Beekenkamp ..... B25H 1/0078 D15/138
4,505,170 A * 3/1985 Van Laere ..... B25B 21/02 81/464
4,619,162 A * 10/1986 Van Laere ..... B25F 3/00 173/104
4,719,976 A * 1/1988 Bleicher ..... B25D 16/003 173/205
4,790,218 A 12/1988 Cabrera
4,905,423 A * 3/1990 van Laere ..... B25F 5/001 81/464
4,977,966 A * 12/1990 Farber ..... B25B 21/026 173/159
5,049,012 A * 9/1991 Cavedo ..... B25F 5/026 408/241 R
5,092,410 A * 3/1992 Wallace ..... B25B 21/02 81/463
D343,345 S * 1/1994 Ogawa ..... D8/69
5,836,403 A * 11/1998 Putney ..... B25B 21/02 173/205
5,888,031 A * 3/1999 Buck ..... B25F 5/026 408/110
6,104,114 A * 8/2000 Takeda ..... H02K 21/16 310/90
6,158,526 A * 12/2000 Ghode ..... B25B 21/026 173/109
6,546,815 B2 * 4/2003 Yamada ..... B25B 21/02 73/862.21
6,553,627 B1 * 4/2003 Horler ..... B25G 1/00 16/427
6,786,683 B2 * 9/2004 Schaer ..... B23B 49/006 408/8
6,935,437 B2 8/2005 Izumisawa
7,032,685 B2 * 4/2006 Nakamizo ..... B25B 23/1453 464/37
7,259,486 B2 * 8/2007 Yamamoto ..... F04D 25/082 310/90
7,401,663 B2 7/2008 Craven et al.
D590,681 S * 4/2009 Palermo ..... D8/68
D591,130 S * 4/2009 Palermo ..... D8/69
D606,377 S * 12/2009 Ho ..... D8/69
7,628,220 B2 12/2009 Barezzani et al.
7,673,702 B2 * 3/2010 Johnson ..... B25B 21/00 173/109
7,823,256 B2 * 11/2010 Engelfried ..... B25F 5/026 16/426
7,905,377 B2 * 3/2011 Krondorfer ..... B25C 1/06 173/90
7,918,286 B2 * 4/2011 Nagasaka ..... B25B 21/02 173/109
7,934,566 B2 * 5/2011 Hlinka ..... B25C 1/06 173/90
8,032,990 B2 * 10/2011 Shinma ..... B25F 5/026 16/426
8,069,929 B2 * 12/2011 Sugimoto ..... B25B 21/026 81/463
8,127,974 B2 * 3/2012 Zhang ..... B25C 1/06 227/129
8,230,607 B2 7/2012 Limberg et al.
8,272,452 B2 9/2012 Katou et al.
8,371,394 B2 * 2/2013 Grand ..... B25B 21/02 173/29
8,371,708 B2 * 2/2013 Nagasaka ..... B25B 23/18 173/217
8,407,860 B2 * 4/2013 Brennenstuhl ..... B25F 5/026 16/422
8,460,153 B2 * 6/2013 Rudolph ..... B25B 21/02 475/344
8,584,770 B2 * 11/2013 Zhang ..... B23Q 5/04 173/178
8,827,003 B2 * 9/2014 Nagasaka ..... B25B 21/023 173/202
8,925,645 B2 * 1/2015 Harada ..... B25B 23/1405 173/9
8,925,646 B2 * 1/2015 Seith ..... B25B 21/02 173/217
8,961,358 B2 * 2/2015 Hirabayashi ..... B25B 21/008 475/300
9,114,521 B2 * 8/2015 Yoshikawa ..... B25F 5/02
9,308,638 B2 * 4/2016 Kondo ..... B25F 5/02
9,321,159 B2 * 4/2016 May ..... B25B 23/1475
9,393,711 B2 * 7/2016 Myrhum, Jr. ..... B26D 5/086
9,415,497 B2 * 8/2016 Hecht ..... B25D 16/003
9,463,566 B2 * 10/2016 Yoshikane ..... B25G 1/01
9,566,692 B2 * 2/2017 Seith ..... B25B 21/02
9,643,300 B2 * 5/2017 Kumagai ..... B25B 21/02
9,849,577 B2 * 12/2017 Wyler ..... B25D 11/125
D835,959 S * 12/2018 Eardley ..... D8/67
10,286,529 B2 5/2019 Kiyohara et al.
10,295,990 B2 * 5/2019 Dey, IV ..... G06F 3/04847
D853,815 S * 7/2019 Yaschur ..... D8/69
10,654,153 B2 * 5/2020 Murakami ..... B25B 21/02
2001/0004939 A1 * 6/2001 Durmeyer ..... E02D 7/06 173/217
2002/0035876 A1 * 3/2002 Donaldson, Jr. .... B25B 23/1456 73/862.21
2005/0121209 A1 * 6/2005 Shimizu ..... B25B 21/00 173/217
2007/0000676 A1 * 1/2007 Arimura ..... B25B 23/1475 173/179
2007/0209162 A1 * 9/2007 McRoberts ..... B25F 5/026 16/426
2007/0267206 A1 * 11/2007 Chen ..... B25B 21/00 173/170
2008/0078067 A1 * 4/2008 Nicolantonio ..... B25F 5/026 16/110.1

(56) References Cited

U.S. PATENT DOCUMENTS

2008/0099217 A1* 5/2008 Seith ..... B25B 21/026 173/1
2009/0000434 A1* 1/2009 Shinma ..... B25D 17/04 81/491
2009/0133894 A1* 5/2009 Mizuhara ..... B25B 21/02 310/156.01
2009/0178520 A1* 7/2009 Engelfried ..... B25D 17/04 81/489
2010/0005629 A1* 1/2010 Di Nicolantonio ..... B25F 5/026 16/426
2010/0064480 A1 3/2010 Martin
2010/0064481 A1 3/2010 Martin
2010/0064482 A1* 3/2010 Martin ..... B25F 5/026 16/426
2010/0096155 A1* 4/2010 Iwata ..... B25B 21/02 173/217
2011/0011609 A1* 1/2011 Simm ..... B25F 5/026 173/171
2011/0073334 A1* 3/2011 Iimura ..... B25B 21/02 173/217
2011/0079407 A1* 4/2011 Iimura ..... B25B 23/1405 173/217
2011/0120741 A1* 5/2011 Limberg ..... B25F 5/02 16/421
2011/0188232 A1* 8/2011 Friedman ..... H02K 16/005 362/119
2011/0315417 A1* 12/2011 Matsunaga ..... B25B 21/008 173/176
2012/0073846 A1* 3/2012 Hirai ..... B25B 21/02 173/200
2012/0199372 A1* 8/2012 Nishikawa ..... B25B 21/02 173/132
2012/0234566 A1* 9/2012 Mashiko ..... B25B 21/02 173/93.5
2012/0279736 A1* 11/2012 Tanimoto ..... B25B 21/026 173/117
2012/0292065 A1* 11/2012 Hoshi ..... B25B 21/02 173/93
2012/0292070 A1* 11/2012 Ito ..... H02K 11/33 173/217
2012/0312572 A1 12/2012 Nemetz et al.
2012/0318549 A1* 12/2012 Nagasaka ..... B25F 5/02 173/109
2012/0318550 A1* 12/2012 Tanimoto ..... B25B 23/1475 173/117
2012/0319508 A1* 12/2012 Oomori ..... B25B 21/02 310/50
2013/0000934 A1* 1/2013 Tadokoro ..... B25B 21/00 173/90
2013/0008679 A1* 1/2013 Nishikawa ..... B25B 21/02 173/93
2013/0014967 A1* 1/2013 Ito ..... B25F 5/00 173/93
2013/0025892 A1* 1/2013 Mashiko ..... B25B 21/026 173/2
2013/0062086 A1* 3/2013 Ito ..... B25B 23/1475 173/1
2013/0062088 A1* 3/2013 Mashiko ..... B25B 21/02 173/48
2013/0075121 A1* 3/2013 Nakamura ..... B25B 21/02 173/94
2013/0087355 A1* 4/2013 Oomori ..... B25B 21/02 173/94
2013/0126202 A1* 5/2013 Oomori ..... B25B 21/00 173/217
2013/0133911 A1* 5/2013 Ishikawa ..... B25B 21/026 173/176
2013/0139614 A1* 6/2013 Johnson ..... B23P 19/066 73/862.21
2013/0233584 A1* 9/2013 Mashiko ..... B25F 5/001 173/181
2013/0270932 A1* 10/2013 Hatfield ..... H02K 9/22 310/50
2013/0270934 A1* 10/2013 Smith ..... H02K 7/145 310/50
2013/0284480 A1 10/2013 Horie et al.
2013/0333910 A1* 12/2013 Tanimoto ..... B25B 23/1475 173/176
2014/0014385 A1 1/2014 Kosugi et al.
2014/0069672 A1* 3/2014 Mashiko ..... B25B 21/00 173/47
2014/0124229 A1* 5/2014 Takahashi ..... B25B 21/02 173/93.5
2014/0131059 A1* 5/2014 Verbrugge ..... B25F 5/00 173/217
2014/0138114 A1 5/2014 Takeuchi et al.
2014/0144658 A1* 5/2014 Schmid ..... B25D 17/06 173/90
2014/0145524 A1* 5/2014 Tanimoto ..... H02K 1/2706 310/50
2014/0158388 A1* 6/2014 Johnson ..... B25B 21/02 173/1
2014/0158390 A1* 6/2014 Mashiko ..... B25B 23/147 173/217
2014/0182869 A1* 7/2014 Kumagai ..... B25F 5/02 173/93
2014/0223695 A1 8/2014 Rieger et al.
2014/0224075 A1* 8/2014 Merrick ..... B25B 13/461 81/52
2014/0231113 A1 8/2014 Steurer
2014/0251649 A1* 9/2014 Kondo ..... B23Q 9/00 16/426
2014/0318821 A1* 10/2014 Wyler ..... B25F 5/006 173/104
2014/0371018 A1* 12/2014 Ito ..... B25F 5/001 475/149
2014/0374130 A1* 12/2014 Nakamura ..... B25B 23/1475 173/176
2015/0000946 A1* 1/2015 Amend ..... B25D 11/04 173/93
2015/0022125 A1* 1/2015 Takano ..... H02P 29/68 318/139
2015/0041169 A1* 2/2015 Kumagai ..... B25D 17/26 173/93.7
2015/0041170 A1 2/2015 Yoshikane et al.
2015/0047866 A1* 2/2015 Sakai ..... B25B 21/02 173/217
2015/0075829 A1* 3/2015 Seith ..... B25B 21/02 173/109
2015/0083448 A1* 3/2015 Chen ..... B25B 23/1475 81/464
2015/0083451 A1* 3/2015 Nishikawa ..... B25D 16/006 173/48
2015/0144365 A1* 5/2015 Hirabayashi ..... B25B 23/1405 173/2
2015/0144366 A1 5/2015 Machida
2015/0144368 A1 5/2015 Machida
2015/0174753 A1* 6/2015 Kamiya ..... B25F 5/008 16/426
2015/0209952 A1* 7/2015 Nishii ..... B25F 5/026 173/162.2
2015/0231770 A1* 8/2015 Kusakawa ..... B25B 21/02 173/93.5
2015/0231771 A1* 8/2015 Sakai ..... B25B 21/02 173/176
2015/0266176 A1* 9/2015 Takeuchi ..... B25D 17/24 173/117
2015/0303842 A1* 10/2015 Takano ..... B25F 5/008 173/2
2015/0333664 A1* 11/2015 Bantle ..... B25F 5/02 318/287
2015/0336249 A1* 11/2015 Iwata ..... B25B 23/1475 173/1
2015/0343617 A1* 12/2015 Kondo ..... B25B 21/02 173/93
2015/0352699 A1* 12/2015 Sakai ..... B25B 21/026 173/176

(56) References Cited

U.S. PATENT DOCUMENTS

| | | | | |
|---|---|---|---|---|
| 2016/0008961 | A1* | 1/2016 | Takano | B25F 5/00 173/2 |
| 2016/0075007 | A1 | 3/2016 | Kutsuna et al. | |
| 2016/0079887 | A1* | 3/2016 | Takano | B25F 5/008 318/431 |
| 2016/0107297 | A1* | 4/2016 | Ishikawa | B25B 21/008 173/179 |
| 2016/0129568 | A1* | 5/2016 | Nishikawa | B25B 21/026 173/93 |
| 2016/0136801 | A1 | 5/2016 | Furusawa et al. | |
| 2016/0250743 | A1* | 9/2016 | Kikuchi | B25F 5/02 173/46 |
| 2016/0279782 | A1 | 9/2016 | Ullrich et al. | |
| 2016/0288308 | A1 | 10/2016 | Kuhnle et al. | |
| 2016/0311102 | A1* | 10/2016 | Ebner | B25D 17/02 |
| 2016/0325415 | A1* | 11/2016 | Huber | B25B 23/1475 |
| 2016/0354905 | A1* | 12/2016 | Ely | B25B 21/008 |
| 2017/0021478 | A1* | 1/2017 | Junkers | B25B 13/488 |
| 2017/0028537 | A1* | 2/2017 | McClung | B25B 21/026 |
| 2017/0036327 | A1* | 2/2017 | Murakami | B25B 21/026 |
| 2017/0057064 | A1* | 3/2017 | Ishikawa | B25B 23/1475 |
| 2017/0106517 | A1* | 4/2017 | Machida | B25D 17/24 |
| 2017/0106525 | A1* | 4/2017 | Brauer | B25G 1/06 |
| 2017/0144278 | A1* | 5/2017 | Nishikawa | B25B 21/026 |
| 2017/0151657 | A1* | 6/2017 | Nagasaka | H02K 7/145 |
| 2017/0173768 | A1* | 6/2017 | Dey, IV | B25B 23/1475 |
| 2017/0190027 | A1* | 7/2017 | Koizumi | B25F 5/00 |
| 2017/0190028 | A1* | 7/2017 | Howard | B25B 21/026 |
| 2017/0190032 | A1* | 7/2017 | Leong | B25B 23/1475 |
| 2017/0239801 | A1* | 8/2017 | Kondo | B25B 21/02 |
| 2017/0246732 | A1* | 8/2017 | Dey, IV | B25B 21/026 |
| 2017/0326712 | A1* | 11/2017 | Li | H02K 1/146 |
| 2017/0326720 | A1* | 11/2017 | Kuroyanagi | B25B 21/02 |
| 2017/0348835 | A1* | 12/2017 | Skelly | B25B 23/0078 |
| 2018/0001444 | A1* | 1/2018 | Matsushita | B25F 5/00 |
| 2018/0117745 | A1* | 5/2018 | Murakami | B25D 11/04 |
| 2018/0200872 | A1* | 7/2018 | Leong | B25B 21/002 |
| 2018/0222022 | A1* | 8/2018 | Kumagai | B25F 5/02 |
| 2019/0030692 | A1* | 1/2019 | Harada | B25B 23/1475 |
| 2019/0030696 | A1* | 1/2019 | Seith | B25B 21/02 |
| 2019/0224819 | A1 | 7/2019 | Kiyohara et al. | |
| 2019/0255687 | A1* | 8/2019 | Schneider | B25B 21/02 |
| 2020/0009709 | A1* | 1/2020 | Kumagai | B25B 19/00 |
| 2020/0122281 | A1* | 4/2020 | Wierer | B25F 5/00 |
| 2020/0198100 | A1* | 6/2020 | Schneider | B25B 21/026 |
| 2020/0262037 | A1* | 8/2020 | Schneider | B25B 21/026 |
| 2021/0100170 | A1* | 4/2021 | Suzuki | B25F 5/006 |
| 2021/0237249 | A1* | 8/2021 | Fischer | B25F 5/006 |
| 2021/0260733 | A1* | 8/2021 | Fischer | B25B 23/1475 |
| 2021/0260734 | A1* | 8/2021 | Kubale | B25B 21/023 |

FOREIGN PATENT DOCUMENTS

| | | | |
|---|---|---|---|
| CN | 203843800 | U | 9/2014 |
| CN | 206122746 | U | 4/2017 |
| CN | 206702908 | U | 12/2017 |
| CN | 109500432 | A | 3/2019 |
| CN | 209139897 | U | 7/2019 |
| CN | 209812185 | U | 12/2019 |
| DE | 19738092 | C1 | 12/1998 |
| DE | 102007039245 | | 5/2008 |
| EP | 2944433 | B1 | 6/2017 |
| EP | 3706960 | | 9/2020 |
| JP | 2008183691 | A | 8/2008 |
| JP | 2016097498 | A | 5/2016 |
| JP | 2017080853 | A | 5/2017 |

OTHER PUBLICATIONS

Ingersoll Rand, "285B Series Air Impact Wrench—Exploded View", Edition 7, Jan. 2014, 2 pages.

Ingersoll Rand, "2850MAX Series Air Impactools™—Exploded View", Edition 3, Feb. 2018, 2 pages.

Ingersoll Rand, "1" D-Handle Impact Wrench 2850MAX and 2850MAX-6, Informational Flyer, 2018, 2 pages.

Ingersoll Rand, "Air Impact Wrench Series 285B and 295A" Product Information, Edition 5, Jan. 2014, 36 pages.

International Search Report and Written Opinion for Application No. PCT/US2021/019316 dated Jun. 18, 2021 (14 pages).

International Search Report and Written Opinio for Application No. PCT/US2019/064583 dated Apr. 10, 2020 (12 pages).

Beacham, "Best Rotary Hammers," available at <https://bestreviews.com/tools/hammers/best-rotary-hammers> dated Oct. 1, 2021 (2 pages).

Musyoka et al., "Best Rotary Hammers: Drill and Chisel More Efficiently," available at <https://www.thedrive.com/reviews/31029/best-rotary-hamer-drill> dated Aug. 20, 2021 (9 pages).

Extended European Search Report for Application No. 19895397.8 dated Dec. 14, 2022 (8 pages).

* cited by examiner

HIGH TORQUE IMPACT TOOL

CROSS-REFERENCE TO RELATED APPLICATIONS

This application claims priority to U.S. Provisional Patent Application No. 62/777,501, filed Dec. 10, 2018, the entire content of which is incorporated herein by reference.

FIELD OF THE INVENTION

The present invention relates to power tools, and more specifically to impact tools.

BACKGROUND OF THE INVENTION

Impact tools or wrenches are typically include a hammer that impacts an anvil to provide a striking rotational force, or intermittent applications of torque, to a workpiece (e.g., a fastener) to either tighten or loosen the fastener. High torque impact wrenches are capable of delivering very large amounts of torque to fasteners. As such, high torque impact wrenches are typically used to loosen or remove large and/or stuck fasteners (e.g., an automobile lug nut on an axle stud) that are otherwise not removable or very difficult to remove using hand tools, drills, or smaller, lighter-duty impact drivers.

SUMMARY OF THE INVENTION

The present invention provides, in one aspect, an impact tool including a housing extending along a longitudinal axis. The housing includes a motor housing portion, a first handle extending from the motor housing portion, and a front housing coupled to the motor housing portion opposite the first handle. The impact tool also includes a motor supported within the motor housing portion, an anvil extending from the front housing, and an impact mechanism supported within the front housing. The impact mechanism is driven by the motor to deliver incremental rotational impacts to the anvil. The impact tool also includes a battery receptacle configured to receive a removable battery pack, a trigger switch actuatable to energize the motor, and an auxiliary handle assembly. The auxiliary handle assembly includes a mount coupled to the housing, an auxiliary handle coupled to the mount and spaced from the first handle, and an adjustment mechanism. Loosening the adjustment mechanism permits rotation of the auxiliary handle assembly about the longitudinal axis relative to the housing, and tightening the adjustment mechanism secures the auxiliary handle assembly in a selected rotational position.

In some embodiments, the mount includes a band clamp surrounding the front housing.

In some embodiments, the band clamp includes a ring portion having a plurality of detents configured to engage a plurality of recesses on the front housing.

In some embodiments, the band clamp includes a first tab and a second tab spaced from the first tab, and tightening the adjustment mechanism decreases a spacing between the first and second tabs to reduce a diameter of the ring portion.

In some embodiments, the adjustment mechanism includes an actuator, a first clamp member biased into engagement with the first tab, and a second clamp member biased into engagement with the second tab.

In some embodiments, the adjustment mechanism includes a rod extending along a second axis orthogonal to the longitudinal axis, and the rod extends through the first clamp member, the first tab, the second clamp member, and the second tab.

In some embodiments, the rod includes a threaded portion and a head opposite the threaded portion, the adjustment mechanism includes a seat opposite the actuator, the threaded portion is threadably coupled to the actuator, and the head is fixed to the seat.

In some embodiments, the adjustment mechanism includes a first biasing member extending between the actuator and the first clamp member and a second biasing member extending between the head and the second clamp member.

In some embodiments, the adjustment mechanism includes a third biasing member extending between the first tab and the second tab.

In some embodiments, the plurality of detents is engageable with the plurality of recesses to provide tactile feedback when the mount is rotated about the longitudinal axis relative to the housing.

In some embodiments, loosening the adjustment mechanism permits rotation of the auxiliary handle relative to the mount about a second axis orthogonal to the longitudinal axis.

The present invention provides, in another aspect, an impact tool including a housing extending along a longitudinal axis. The housing includes a motor housing portion and a front housing coupled to the motor housing portion. The impact tool also includes a motor supported within the motor housing portion, an anvil extending from the front housing, and an impact mechanism supported within the front housing. The impact mechanism is driven by the motor to deliver incremental rotational impacts to the anvil. The impact tool also includes a battery receptacle configured to receive a removable battery pack, a trigger switch actuatable to energize the motor, a first handle extending from the motor housing portion, and a second handle coupled to the front housing.

In some embodiments, the second handle substantially surrounds the front housing.

In some embodiments, the trigger switch is located on the second handle.

In some embodiments, the trigger switch includes a rocker switch.

In some embodiments, the trigger switch is located on the first handle.

In some embodiments, at least one of the first handle or the second handle is adjustable.

In some embodiments, the second handle is slidable along the housing in a direction parallel to the longitudinal axis.

In some embodiments, the second handle is pivotable about a handle axis orthogonal to the longitudinal axis.

In some embodiments, the second handle is rotatable about the longitudinal axis.

In some embodiments, the impact tool includes stand coupled to the second handle.

In some embodiments, the first handle includes a first grip portion and a second grip portion, the trigger switch is a first trigger switch located on the first grip portion, the impact tool further includes a second trigger switch located on the second grip portion, and the second trigger switch is actuatable to electrically connect the battery pack to the motor to energize the motor.

In some embodiments, the first handle includes a first grip portion extending along a first grip axis, and the first grip axis is inclined at an angled between 35 degrees and 45 degrees relative to the longitudinal axis.

In some embodiments, at least one of the first handle or the second handle is rotatable relative to the housing about the longitudinal axis, and at least one of the first handle or the second handle is pivotable relative to the housing about a handle axis orthogonal to the longitudinal axis.

The present disclosure provides, in another aspect, an impact tool including a housing extending along a longitudinal axis. The housing includes a motor housing portion and a front housing coupled to the motor housing portion. The impact tool also includes a motor supported within the motor housing portion, an anvil extending from the front housing, an impact mechanism supported within the front housing, the impact mechanism driven by the motor to deliver incremental rotational impacts to the anvil, a battery receptacle configured to receive a removable battery pack, a trigger switch actuatable to energize the motor, a first handle extending from the motor housing portion, and an auxiliary handle assembly. The auxiliary handle assembly includes a mount coupled to the housing, an auxiliary handle coupled to the mount and spaced from the first handle, and an adjustment mechanism. At least one of the first handle or the auxiliary handle is rotatable relative to the housing about the longitudinal axis, and at least one of the first handle or the auxiliary handle is pivotable relative to the housing about a handle axis orthogonal to the longitudinal axis.

In some embodiments, the adjustment mechanism includes an actuator rotatable about the handle axis in a loosening direction and a tightening direction.

In some embodiments, rotation of the actuator in the loosening direction permits the auxiliary handle assembly to be rotated relative to the housing about the longitudinal axis between a plurality of rotational positions, and the auxiliary handle assembly is securable in one of the plurality of rotational positions by rotating the actuator in the tightening direction.

In some embodiments, rotation of the actuator in the loosening direction permits the auxiliary handle to be pivoted relative to the mount about the handle axis between a plurality of rotational positions, and the auxiliary handle is securable in one of the plurality of rotational positions by rotating the actuator in the tightening direction.

In some embodiments, the mount includes a band clamp surrounding the front housing, and the band clamp includes a ring portion having a plurality of detents configured to engage a plurality of recesses on the front housing.

In some embodiments, the band clamp includes first and second tabs extending from the ring portion, and the adjustment mechanism includes a threaded rod extending through the first and second tabs.

Other features and aspects of the invention will become apparent by consideration of the following detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 1:
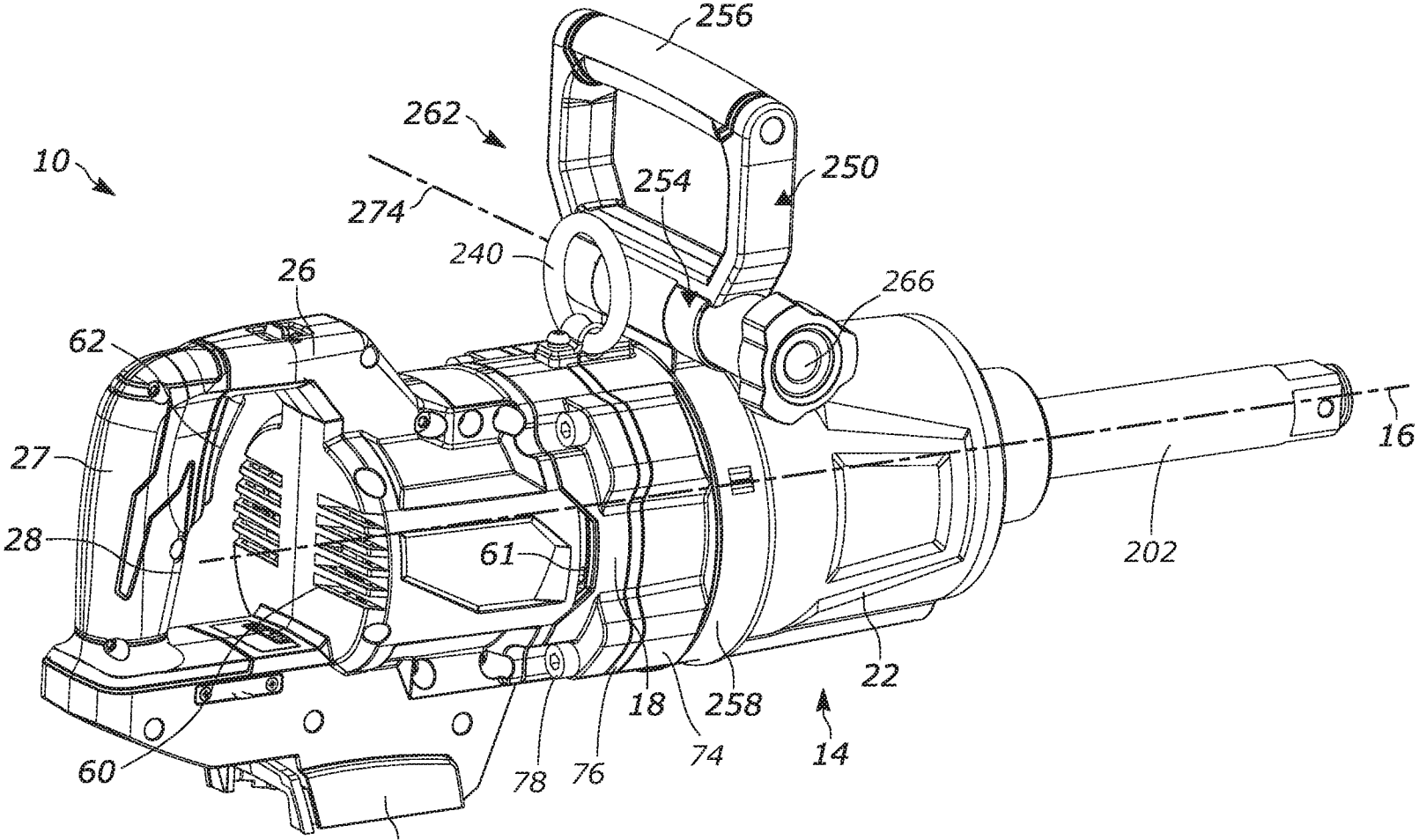
FIG. 1 is a perspective view of an impact wrench according to one embodiment.

FIG. 1 illustrates a power tool in the form of an impact tool or impact wrench 10. The impact wrench 10 includes a housing 14 extending along a longitudinal axis 16. The housing 14 includes a motor housing portion 18, a front housing portion 22 coupled to the motor housing portion 18, and a generally D-shaped handle portion forming a first handle 26 disposed rearward of the motor housing portion 18. The handle portion 26 has a grip 27 that can be grasped by a user operating the impact wrench 10. The grip 27 is spaced from the motor housing portion 18 such that an aperture 28 is defined between the grip 27 and the motor housing portion 18.

The impact wrench 10 may be powered by a battery pack (not shown) removably coupled to a battery receptacle 38 located at a bottom end of the handle portion 26. The battery pack may include a plurality of rechargeable battery cells electrically connected to provide a desired output (e.g., nominal voltage, current capacity, etc.) of the battery pack. Each battery cell may have a nominal voltage between about 3 Volts (V) and about 5 V. The battery pack may have a nominal capacity of at least 5 Amp-hours (Ah) (e.g., with two strings of five series-connected battery cells (a "5S2P" pack)). In some embodiments, the battery pack may have a nominal capacity of at least 9 Ah (e.g., with three strings of five series-connected battery cells (a "5S3P pack"). The illustrated battery pack may have a nominal output voltage of at least 18 V. The cells may have a Lithium-based chemistry (e.g., Lithium, Lithium-ion, etc.) or any other suitable chemistry.

Figure 2:
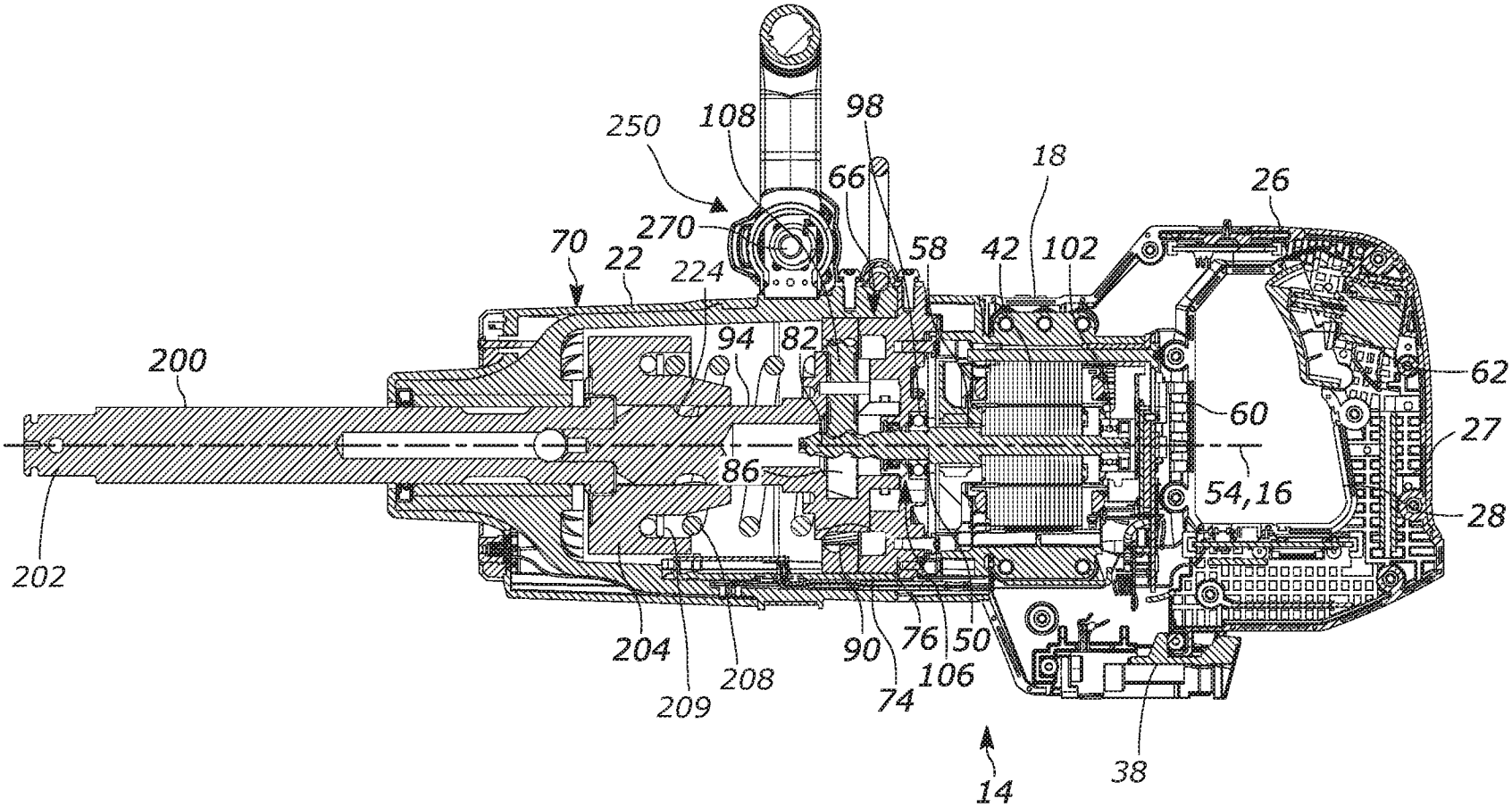
FIG. 2 is a cross-sectional view of the impact wrench of FIG. 1.

Referring to FIG. 2, an electric motor 42, supported within the motor housing portion 18, receives power from the battery pack when the battery pack is coupled to the battery receptacle 38. The motor 42 is preferably a brushless direct current ("BLDC") motor with an output shaft 50 that is rotatable about an axis 54. In the illustrated embodiment, the axis 54 is coaxial with the longitudinal axis 16 of the housing 14, such that the impact wrench 10 has an in-line configuration. A fan 58 is coupled to the output shaft 50 (e.g., via a splined connection) in front of the motor 42. The fan 58 is configured to draw cooling air in through inlet openings 60 (FIG. 1) in the handle portion 26, which, in the illustrated embodiment, are positioned along a front periphery of the aperture 28. The fan 58 conveys the cooling air through the motor housing portion 18 and past the motor 42 in a forward direction parallel to the axes 16, 54. The cooling air is then redirected radially outward by the fan 58 through exhaust openings 61 (FIG. 1) in the motor housing portion 18.

The impact wrench 10 includes a trigger switch 62 provided on the first handle 26 to selectively electrically connect the motor 42 and the battery pack 34 and thereby provide DC power to the motor 42. In other embodiments, the impact wrench 10 may include a power cord for electrically connecting the switch 62 and the motor 42 to a source of AC power. As a further alternative, the impact wrench 10 may be configured to operate using a different power source (e.g., a pneumatic power source, etc.). The battery pack 34 is the preferred means for powering the impact wrench 10, however, because a cordless impact wrench advantageously requires less maintenance (e.g., no oiling of air lines or compressor motor) and can be used in locations where compressed air or other power sources are unavailable.

With reference to FIG. 2, the impact wrench 10 further includes a gear assembly 66 coupled to the motor output shaft 50 and a drive assembly 70 coupled to an output of the gear assembly 66. The gear assembly 66 is at least partially housed within a gear case 74 fixed to the housing 14. In particular, in the illustrated embodiment, the gear case 74 includes a flange portion 76 positioned between the front housing portion 22 and the motor housing portion 18 and fixed to the front housing portion 22 and the motor housing portion 18 by a plurality of fasteners 78 (FIG. 1). The fasteners 78 extend in a forward direction in the illustrated embodiment (that is, the heads of the fasteners 78 face rearward), but the fasteners 78 may be arranged differently in other embodiments. The gear case 74 is preferably made of a high-strength material, such as steel or aluminum, in order to resist high torque loads delivered by the motor 42 through the gear assembly 66. In some embodiments, the gear case 74 and the front housing portion 22 may collectively define a front housing of the impact wrench 10.

With continued reference to FIG. 2, the gear assembly 66 may be configured in any of a number of different ways to provide a speed reduction between the output shaft 50 and an input of the drive assembly 70. The illustrated gear assembly 66 includes a helical pinion 82 formed on the motor output shaft 50, a plurality of helical planet gears 86 meshed with the helical pinion 82, and a helical ring gear 90 meshed with the planet gears 86 and rotationally fixed to the gear case 74. The planet gears 86 are mounted on a camshaft 94 of the drive assembly 70 such that the camshaft 94 acts as a planet carrier. Accordingly, rotation of the output shaft 50 rotates the planet gears 86, which then advance along the inner circumference of the ring gear 90 and thereby rotate the camshaft 94. The gear assembly 66 may provide a gear ratio from the output shaft 50 to the camshaft 94 between 10:1 and 14:1, for example.

The output shaft 50 is rotatably supported by a first or forward bearing 98 and a second or rear bearing 102. The helical gears 82, 86, 90 of the gear assembly 66 advantageously provide higher torque capacity and quieter operation than spur gears, for example, but the helical engagement between the pinion 82 and the planet gears 86 produces an axial thrust load on the output shaft 50. Accordingly, the impact wrench 10 includes a front bearing retainer 106 that secures the front bearing 98 both axially (i.e. against forces transmitted along the axis 54) and radially (i.e. against forces transmitted in a radial direction of the output shaft 50). In the illustrated embodiment, the front bearing 98 is seated within a recess in the flange portion 76 of the gear case 74.

The drive assembly 70 of the impact wrench 10 will now be described with reference to FIG. 2. The illustrated drive assembly 70 includes an anvil 200 extending from the front housing portion 22. A tool element (e.g., a socket; not shown) can be coupled to the anvil 200 for performing work on a workpiece (e.g., a fastener). In the illustrated embodiment, the anvil 200 includes a 1-inch square drive end 202. The drive assembly 70 is configured to convert the continuous rotational force or torque provided by the motor 42 and gear assembly 66 to a striking rotational force or intermittent applications of torque to the anvil 200 when the reaction torque on the anvil 200 (e.g., due to engagement between the tool element and a fastener being worked upon) exceeds a certain threshold. In the illustrated embodiment of the impact wrench 10, the drive assembly 66 includes the camshaft 94, a hammer 204 supported on and axially slidable relative to the camshaft 94, and the anvil 200.

The drive assembly 70 further includes a spring 208 biasing the hammer 204 toward the front of the impact wrench 10 (i.e., in the left direction of FIG. 2). In other words, the spring 208 biases the hammer 204 in an axial direction toward the anvil 200, along the longitudinal axis 16. A thrust bearing 209 (e.g., including a washer and a plurality of ball bearings) is positioned between the spring 208 and the hammer 204 to allow the spring 208 and the camshaft 94 to continue to rotate relative to the hammer 204 after each impact strike when lugs (not shown) on the hammer 204 engage with corresponding lugs (not shown) on the anvil 200 and rotation of the hammer 204 momentarily stops. The camshaft 94 further includes cam grooves 224 in which corresponding cam balls (not shown) are received.

The cam balls are in driving engagement with the hammer 204 and movement of the cam balls within the cam grooves 224 allows for relative axial movement of the hammer 204 along the camshaft 94 when the hammer lugs and the anvil lugs are engaged and the camshaft 94 continues to rotate.

The impact wrench 10 is capable of applying a large fastening torque to a fastener. As defined herein, the term "fastening torque" means torque applied to a fastener in a direction increasing tension (i.e. in a tightening direction). In particular, the drive assembly 70 of the impact wrench 10 converts the continuous torque input from the motor 42 to deliver consecutive rotational impacts on a workpiece producing at least 1,700 ft-lbs of fastening torque without exceeding 100 Amps (A) of current drawn by the motor 42. In some embodiments, the drive assembly 70 delivers consecutive rotational impacts on a workpiece, producing at least 1,700 ft-lbs of fastening torque without exceeding 80 A of current drawn by the motor 42.

In some embodiments, the drive assembly 70 delivers consecutive rotational impacts on a workpiece, producing at least 1,800 ft-lbs of fastening torque without exceeding 100 A of current drawn by the motor 42. In some embodiments, the drive assembly 70 delivers consecutive rotational impacts on a workpiece, producing at least 1,800 ft-lbs of fastening torque without exceeding 80 A of current drawn by the motor 42.

In some embodiments, the drive assembly 70 delivers consecutive rotational impacts on a workpiece, producing at least 1,900 ft-lbs of fastening torque without exceeding 100 A of current drawn by the motor 42. In some embodiments, the drive assembly 70 delivers consecutive rotational impacts on a workpiece, producing at least 1,900 ft-lbs of fastening torque without exceeding 80 A of current drawn by the motor 42.

In some embodiments, the drive assembly 70 delivers consecutive rotational impacts on a workpiece, producing at least 2,000 ft-lbs of fastening torque without exceeding 100 A of current drawn by the motor 42. In some embodiments, the drive assembly 70 delivers consecutive rotational impacts on a workpiece, producing at least 2,000 ft-lbs of fastening torque without exceeding 80 A of current drawn by the motor 42. In some embodiments, the drive assembly 70 delivers consecutive rotational impacts on a workpiece, producing at least 3,500 ft-lbs of fastening torque.

Referring to FIG. 1, the impact wrench 10 includes a hook ring 240 coupled to the housing 14. In some embodiments, the hook ring 240 may be fastened directly to the gear case 74 and/or flange portion 76. The hook ring 240 may provide an attachment point for a harness, lanyard, or the like. The illustrated impact wrench 10 further includes an auxiliary handle assembly or second handle assembly 250 coupled to the housing 14.

Figure 3A:
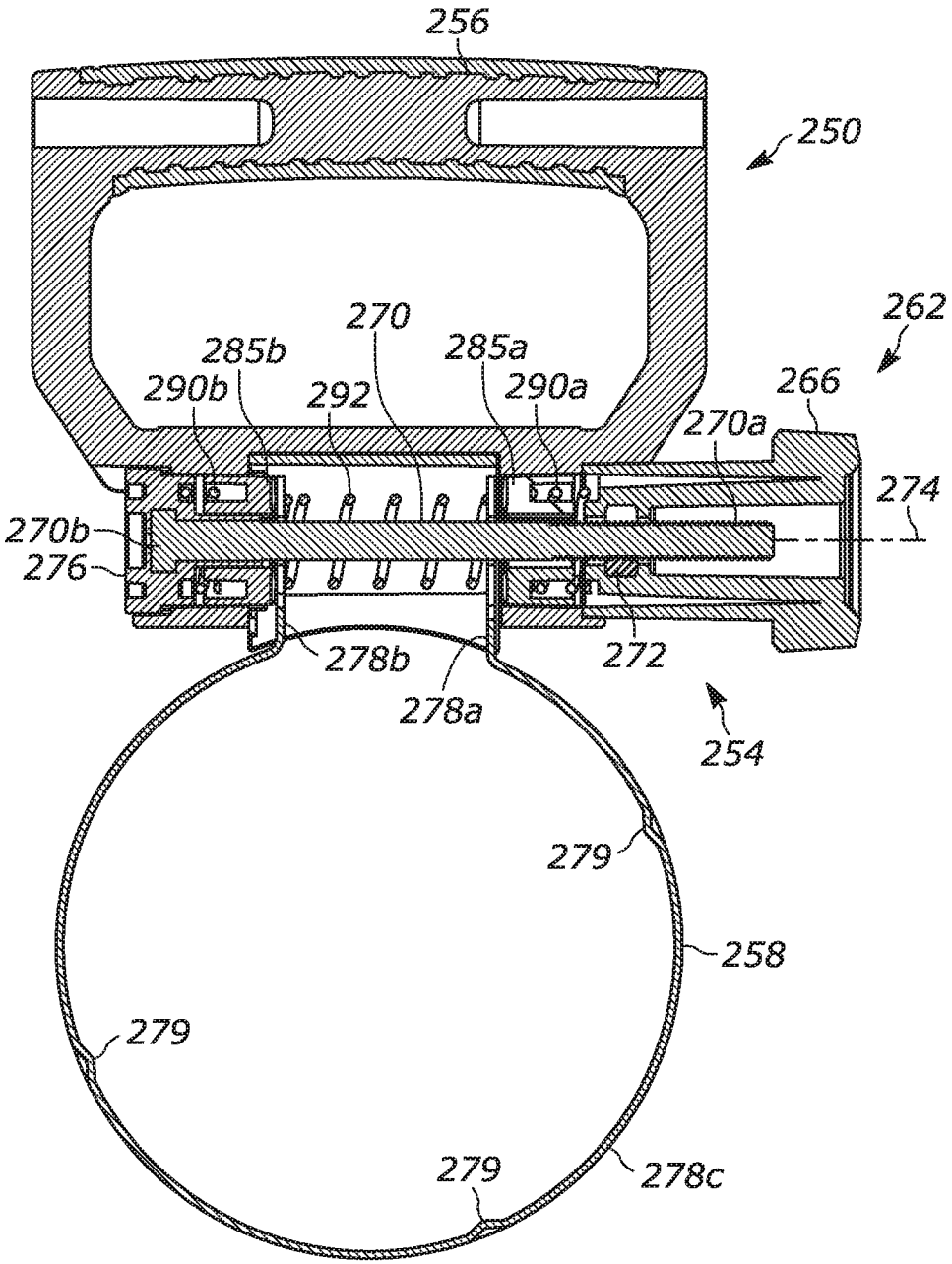
FIG. 3A is a cross-sectional view of an auxiliary handle of the impact wrench of FIG. 1.
Figure 3B:
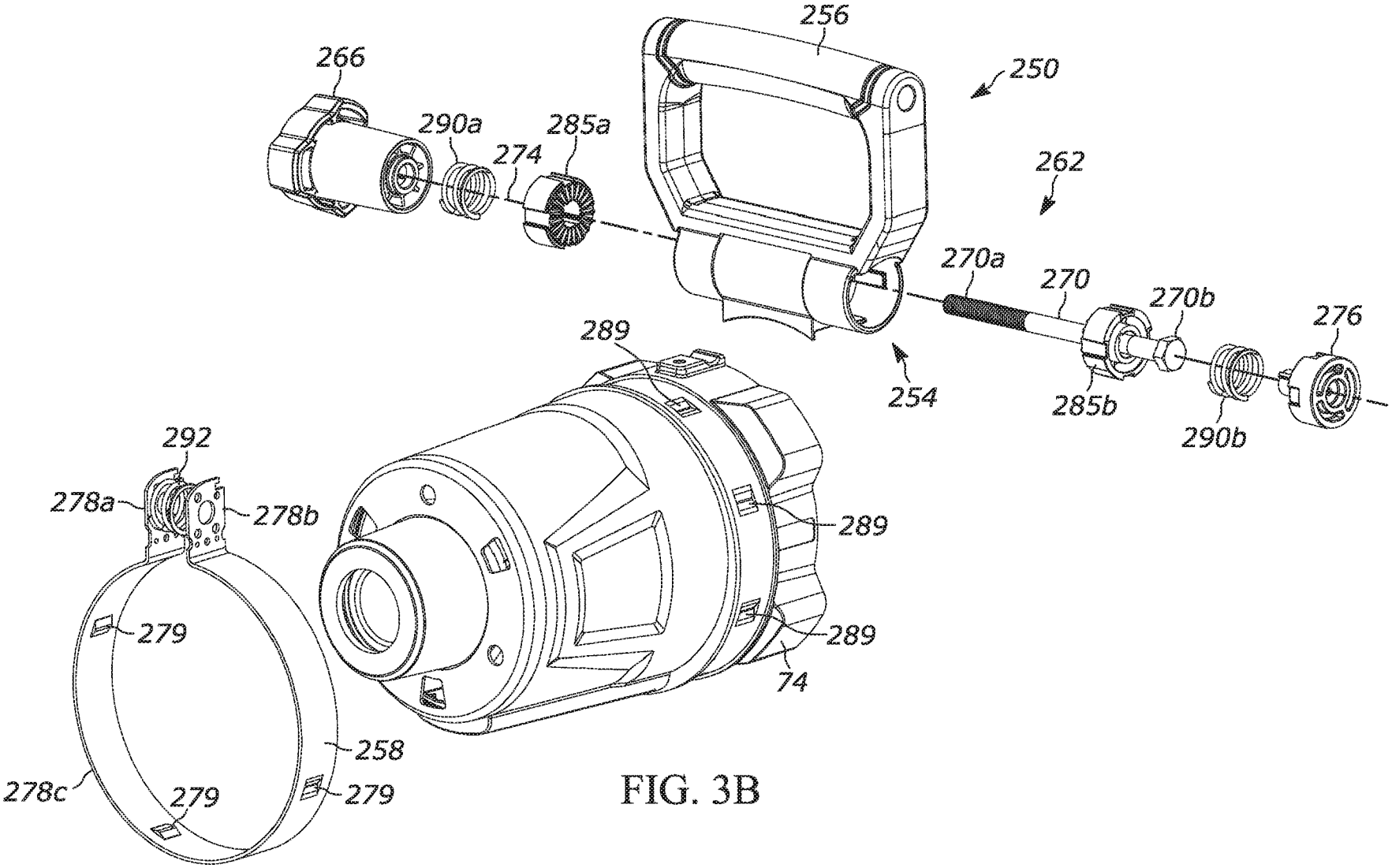
FIG. 3B is an exploded view illustrating the auxiliary handle of FIG. 3A.

Referring to FIGS. 3A-3B, the illustrated auxiliary handle assembly 250 includes a mount 254, an auxiliary handle 256 coupled to the mount 254, and an adjustment mechanism 262 for adjusting a position of the auxiliary handle 256 relative to the housing 14. The illustrated mount 254 includes a band clamp 258 that surrounds the front housing portion 22. The illustrated auxiliary handle 256 is a generally U-shaped handle with a central grip portion. In some embodiments, the central grip portion may be covered by an elastomeric overmold.

With reference to FIGS. 3A-3B, the illustrated adjustment mechanism 262 includes an actuator 266 that is coupled to a rod 270. In particular, the rod 270 includes a threaded portion 270*a* that is in threaded engagement with a nut 272 fixed to the actuator 266. The rod 270 includes a head 270*b* opposite the threaded portion 270*a*, and the head 270*b* is fixed to a seat 276 opposite the actuator 266. Rotation of the actuator 266 and the nut 272 relative to the rod 270 about a longitudinal axis 274 of the rod 270 may thus increase or decrease a spacing between the actuator 266 and the seat 276. In the illustrated embodiment, the longitudinal axis 274 of the rod 270 is orthogonal to the longitudinal axis 16 of the housing 14; however, the orientation of the axis 274 may vary in other embodiments.

The band clamp 258 includes first and second tabs 278*a*, 278*b* extending from a ring portion 278*c*. The tabs 278*a*, 278*b* are spaced from each other, and the ring portion 278*c* is flexible such that the diameter of the ring portion 278*c* can be varied by changing the spacing between the tabs 278*a*, 278*b*. The ring portion 278*c* in the illustrated embodiment includes a plurality of detents 279 circumferentially spaced about the inner periphery of the ring portion 278*c*. In the illustrated embodiment, the gear case 74 includes a plurality of recesses 289 circumferentially spaced about the outer periphery of the gear case 74 (FIG. 3B). The detents 279 are selectively engageable with the recesses 289 to retain the second handle 250 and the mount 254 in any of a plurality of predetermined rotational positions. In some embodiments, the number of recesses 289 may be greater than the number of detents 279.

In some embodiments, the detents 279 may be formed by indenting the outer side of the ring portion 278*c*. The tabs 278*a*, 278*b*, the ring portion 278*c*, and the detents 279 may be integrally formed together from a single piece of sheet material, such as steel, via a stamping and bending process. In other embodiments, the gear case 74 may include the detents 279, and the inner periphery of the ring portion 278*c* may include the recesses 289.

With continued reference to FIGS. 3A-3B, the adjustment mechanism 262 includes a first clamp member 285*a* biased into engagement with the first tab 278*a* by a first spring 290*a* and a second clamp member 285*b* biased into engagement with the second tab 278*b* by a second spring 290*b*. The first spring 290*a* extends between the actuator 266 and the first clamp member 285*a*. The second spring 290*b* extends between the seat 276 and the second clamp member 285*b*. In the illustrated embodiment, a third spring 292 is disposed between the tabs 278*a*, 278*b* to bias the tabs 278*a*, 278*b* into engagement with the clamp members 285*a*, 285*b*.

In operation of the impact wrench 10, an operator grasps the first handle 26 with one hand and the second handle 250 with the other. The operator depresses the trigger switch 62 to activate the motor 42, which continuously drives the gear assembly 66 and the camshaft 94 via the output shaft 50. As the camshaft 94 rotates, the cam balls 228 drive the hammer 204 to co-rotate with the camshaft 94, and the hammer lugs engage, respectively, driven surfaces of the anvil lugs 220 to provide an impact and to rotatably drive the anvil 200 and the tool element. After each impact, the hammer 204 moves or slides rearward along the camshaft 94, away from the anvil 200, so that the hammer lugs disengage the anvil lugs 220. As the hammer 204 moves rearward, the cam balls situated in the respective cam grooves 224 in the camshaft 94 move rearward in the cam grooves 224. The spring 208 stores some of the rearward energy of the hammer 204 to provide a return mechanism for the hammer 204. After the hammer lugs 218 disengage the respective anvil lugs 220, the hammer 204 continues to rotate and moves or slides forwardly, toward the anvil 200, as the spring 208 releases its stored energy, until the drive surfaces of the hammer lugs re-engage the driven surfaces of the anvil lugs 220 to cause another impact.

The auxiliary handle assembly 250 advantageously gives the operator improved control when operating the impact wrench 10 by allowing the operator to stabilize and support the front housing portion 22, and to hold the impact wrench 10 in a manner where the operator can better absorb axial vibration created by the reciprocating hammer 204. Because the auxiliary handle assembly 250 is adjustable, the operator can position the auxiliary handle 256 in a variety of different orientations for improved comfort, ergonomics, and to increase the usability of the impact wrench 10 in tight spaces.

For example, rotation of the actuator 266 about the axis 274 in a loosening direction (i.e. loosening the adjustment mechanism 262) permits adjustment of the second handle 250 between a plurality of positions relative to the housing 14. In particular, loosening the adjustment mechanism 262 increases the spacing between the actuator 266 and the seat 276, which decreases the compressive load on the first and second springs 290*a*, 290*b*. The tabs 278*a*, 278*b* may then move apart (e.g., under the influence of the third spring 292), which loosens the band clamp 258 to permit rotation of the auxiliary handle assembly 250 relative to the housing 14 about the longitudinal axis 16. In some embodiments, the detents 279 may remain at least partially engaged with the recesses 289 to retain the auxiliary handle assembly 250 in their current position until an operator exerts sufficient force on the auxiliary handle 256.

With the adjustment mechanism 262 loosened, the operator may rotate the auxiliary handle assembly 250 about the longitudinal axis 16 to a desired rotational position. As the operator rotates the auxiliary handle assembly 250, the detents 279 may at least partially engage the recesses 289 to provide the operator with tactile feedback at each of the plurality of predetermined rotational positions. Once the auxiliary handle assembly 250 reaches a desired position, the operator may tighten the adjustment mechanism 262 by rotating the actuator 266 about the axis 274 in a tightening direction (i.e. tightening the adjustment mechanism 262).

Tightening the adjustment mechanism 262 decreases the spacing between the actuator 266 and the seat 276, which increases the compressive load on the first and second springs 290*a*, 290*b*. The springs 290*a*, 290*b* overcome the third spring 292 and press the tabs 278*a*, 278*b* toward each other. The ring portion 279 is thus tightened around the gear case 74, and the detents 279 are held in the recesses 289. The detents 279 and the recesses 289 advantageously provide a positive locking connection that may better resist torque between the handle 250 and the housing 14 than a friction connection alone, for example.

In some embodiments, the auxiliary handle 256 may also be rotatable about the axis 274 relative to the mount 254. In such embodiments, loosening the adjustment mechanism 262 may also permit rotation of the auxiliary handle 256 relative to the mount 254. Alternatively, a separate adjustment mechanism for adjusting the orientation of the auxiliary handle 256 relative to the mount 254 may be provided.

Figure 4B:
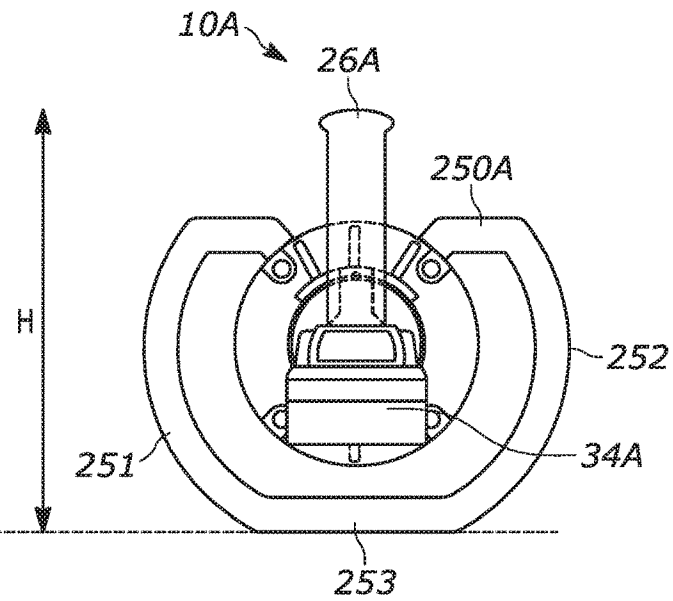
FIG. 4B is a rear view of the impact wrench of FIG. 4A.
Figure 4A:
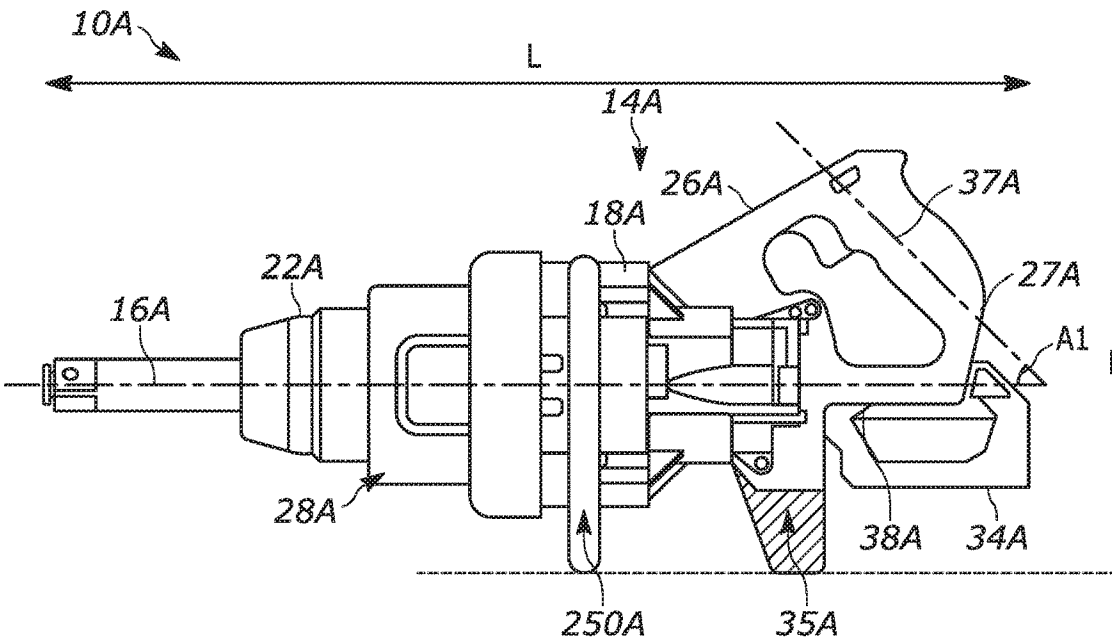
FIG. 4A is a side view of an impact wrench according to another embodiment.

FIGS. 4A-4B illustrate an impact wrench 10A according to another embodiment. The impact wrench 10A is similar to the impact wrench 10 described above with reference to FIGS. 1-3B. Accordingly, features and elements of the impact wrench 10A corresponding with features and elements of the impact wrench 10 are given like reference numbers followed by the letter 'A.' In addition, the following description focuses primarily on differences between the impact wrench 10A and the impact wrench 10.

The impact wrench 10A includes a housing 14A with a motor housing portion 18A, a front housing portion 22A, and a handle portion 26A or first handle 26A extending from the motor housing portion 18A opposite the front housing portion 22A. The impact wrench 10A defines an overall length L of about 22.6 inches and an overall height H of about 9.6 inches. A grip portion 27A of the first handle 26A defines a handle axis 37A, which is obliquely oriented relative to the longitudinal axis 16A. In the illustrated embodiment, the handle axis 37A is inclined at an angle A1 of about 35 degrees relative to the longitudinal axis 16A.

With continued reference to FIGS. 4A-4B, a battery pack 34A is coupled to a battery receptacle 38A below the first handle 26A. In some embodiments, the first handle 26A may include a foot 35A (FIG. 4A) that extends below the underside of the battery pack 34A, which may protect the battery pack 34A when setting the impact wrench 10A down on the ground, for example.

The second handle 250A is fixed to the motor housing portion 18A and is shaped as a loop handle or bail handle, such that the second handle 250A surrounds a substantial portion of the circumference of the motor housing portion. The second handle 250A includes curved gripping portions 251, 252 and a flat portion 253 centered between the curved gripping portions 251, 252 and extending laterally across the underside of the impact wrench 10A. As such, the flat portion 253 and the foot 35A together form a stand that can support the impact wrench 10A when the impact wrench is placed on the ground, for example.

Referring to FIG. 4A, an elastomeric boot 28A is provided on the front housing portion 22A in the illustrated embodiment. In some embodiments, the elastomeric boot 28A may be overmolded on the front housing portion 22A. In other embodiments, the elastomeric boot 28A may be removable from the front housing portion 22A. The elastomeric boot 28A may provide a comfortable, alternative location for an operator to support the front of the impact wrench 10A, and may provide protection from drops, etc.

Figure 5B:
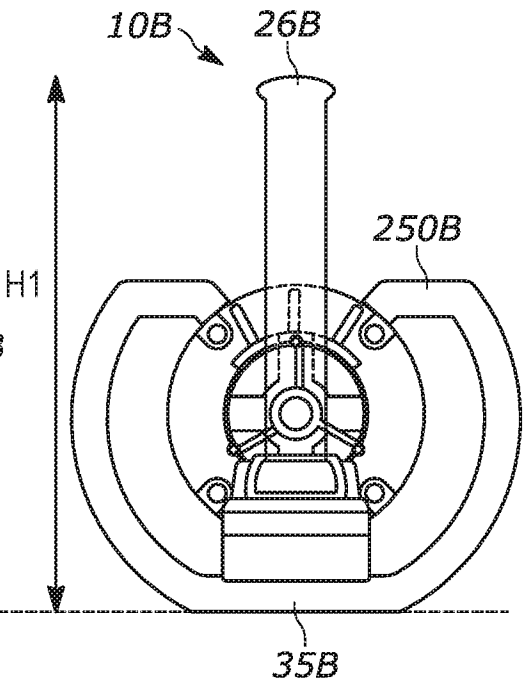
FIG. 5B is a rear view of the impact wrench of FIG. 5A.
Figure 5A:
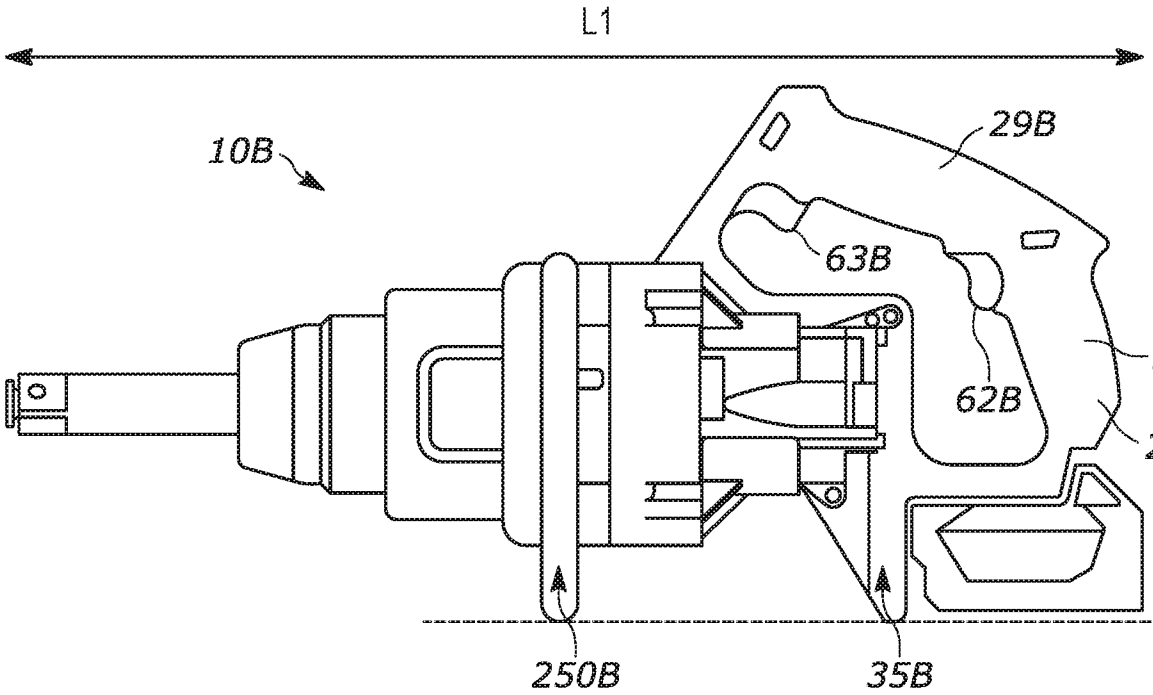
FIG. 5A is a side view of an impact wrench according to another embodiment.

FIGS. 5A-5B illustrate an impact wrench 10B according to another embodiment. The impact wrench 10B is similar to the impact wrench 10A described above with reference to FIGS. 4A-4B. Accordingly, features and elements of the impact wrench 10B corresponding with features and elements of the impact wrench 10A are given like reference numbers followed by the letter 'B.' In addition, the following description focuses primarily on differences between the impact wrench 10B and the impact wrench 10A.

The impact wrench 10B defines an overall length L1 of about 22.6 inches and an overall height H1 of about 10.5 inches. The first handle 26B includes a first grip portion 27B and a second grip portion 29B extending at an oblique angle from the first grip portion 27B. A first trigger switch 62B is located on the first grip portion 27B, and a second trigger switch 63B is located on the second grip portion 29B. The first handle 26B thus provides two different grip placements, both of which permit operation of the impact wrench 10B. For example, an operator may grasp the first grip portion 27B and actuate the first trigger switch 62B when operating the impact wrench 10 at chest level or overhead. The operator may alternatively grasp the second grip portion 29B and actuate the second trigger switch 63B when operating the impact wrench 10 below chest level. The first handle 26B is thus configured to provide improved ergonomics in a variety of different operating orientations.

Figure 6A:
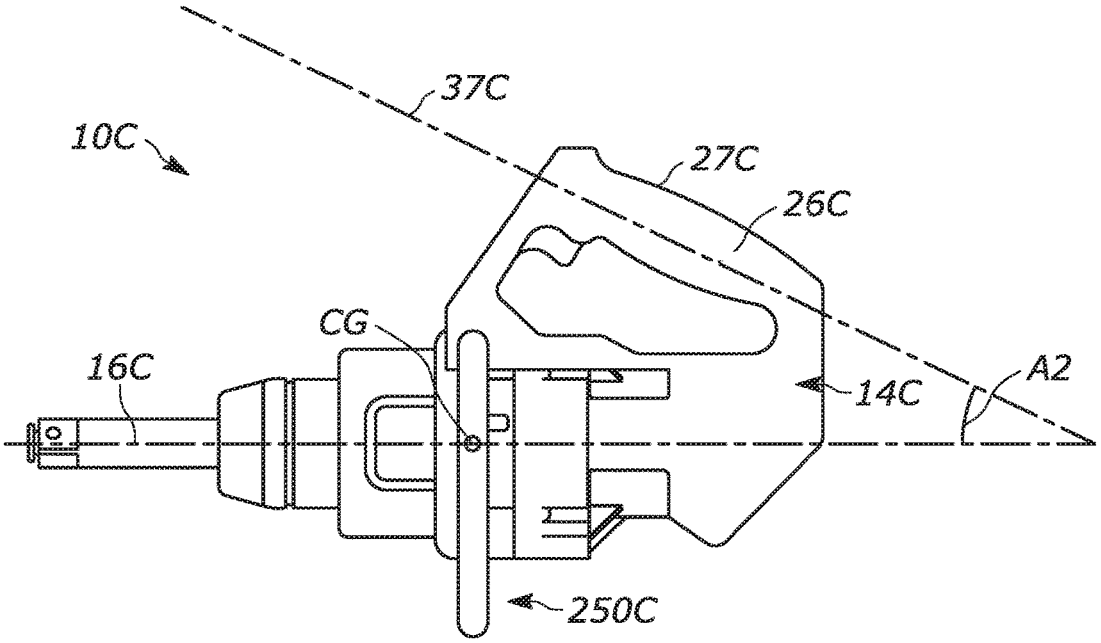
FIG. 6A is a side view of an impact wrench according to another embodiment.
Figure 6B:
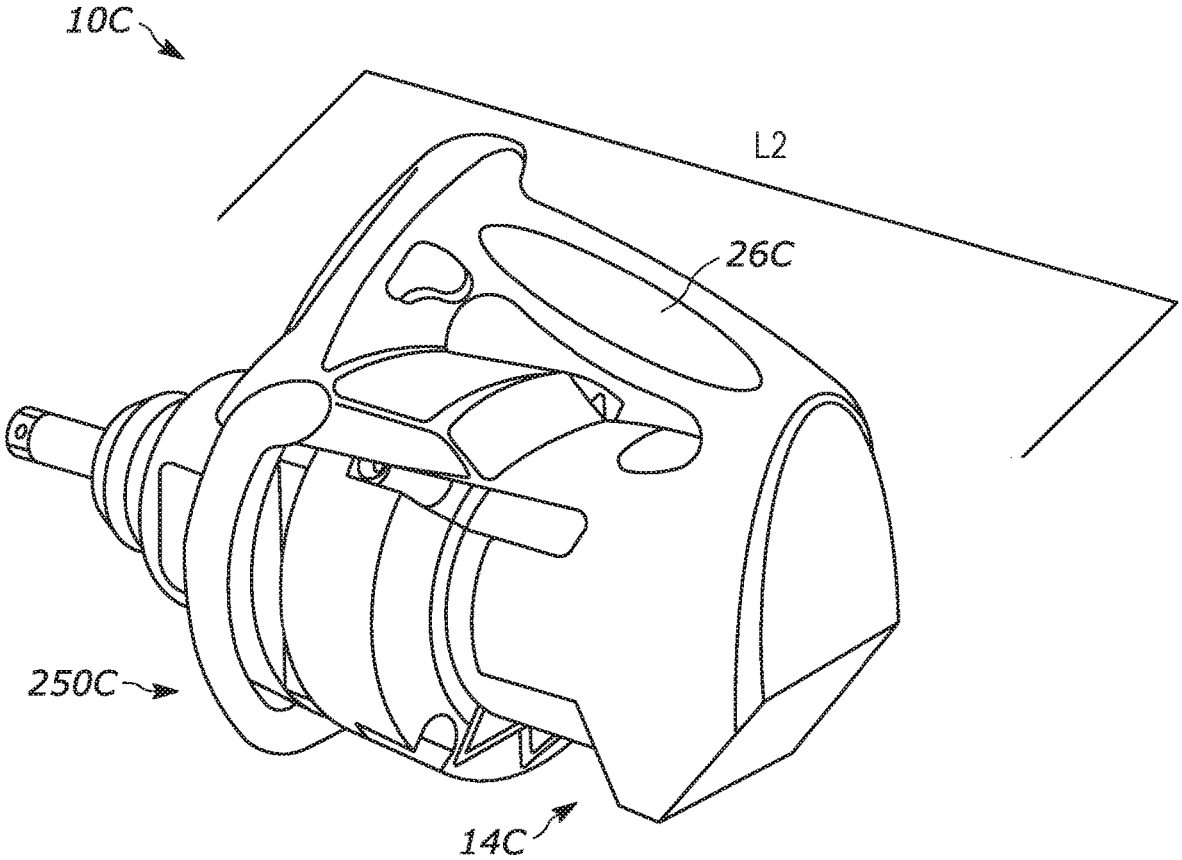
FIG. 6B is a perspective view of the impact wrench of FIG. 6A.

FIGS. 6A-6B illustrate an impact wrench 10C according to another embodiment. The impact wrench 10C is similar to the impact wrench 10A described above with reference to FIGS. 4A-4B. Accordingly, features and elements of the impact wrench 10C corresponding with features and elements of the impact wrench 10A are given like reference numbers followed by the letter 'C.' In addition, the following description focuses primarily on differences between the impact wrench 10C and the impact wrench 10A.

The impact wrench 10C includes a compact housing 14C with a shorter overall length L2 than the length L of the impact wrench 10A. As such, the first handle 26C is positioned closer to a center of gravity CG of the impact wrench 10C. This enhances the balance of the impact wrench 10C when the operator grasps the grip portion 27C of the first handle 26C. The grip portion 27C defines a handle axis 37C, which is obliquely oriented relative to the longitudinal axis 16C. In the illustrated embodiment, the handle axis 37C is inclined at an angle A2 between 35 degrees and 45 degrees relative to the longitudinal axis 16C.

Figure 7B:
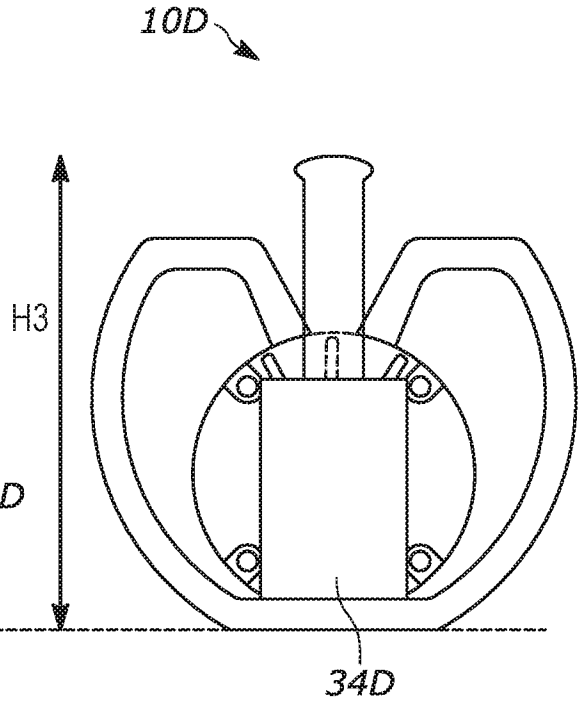
FIG. 7B is a rear view of the impact wrench of FIG. 7A.
Figure 7A:
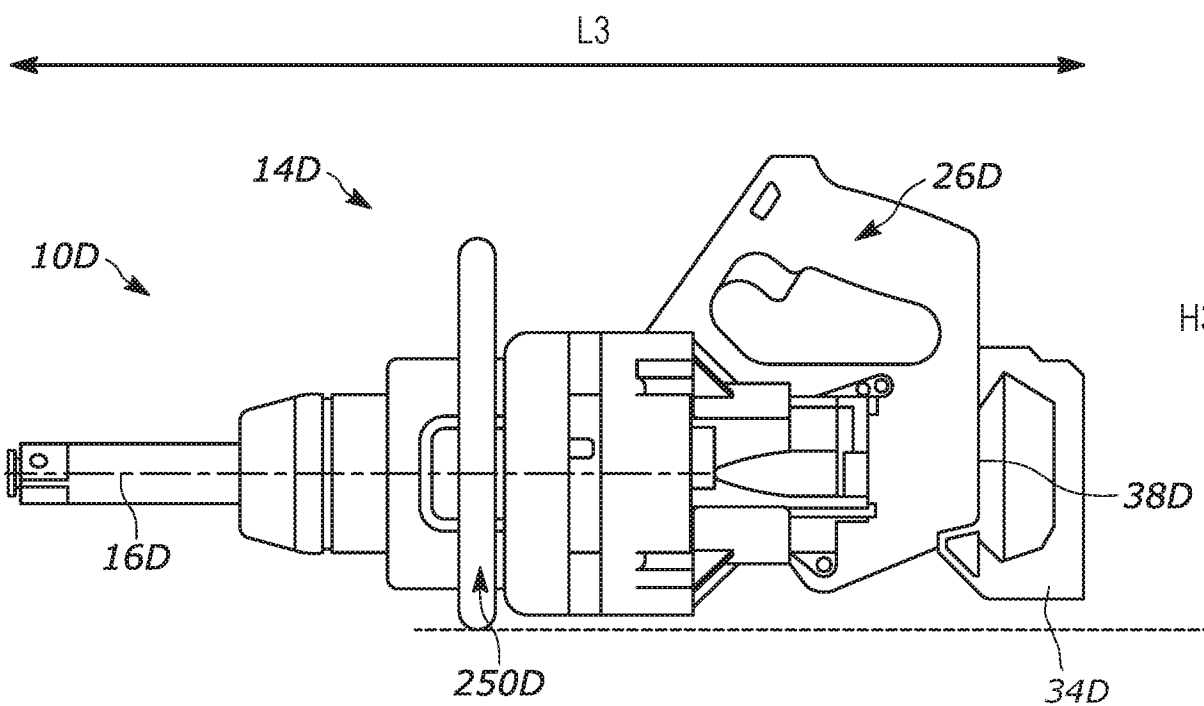
FIG. 7A is a side view an impact wrench according to another embodiment.

FIGS. 7A-7B illustrate an impact wrench 10D according to another embodiment. The impact wrench 10D is similar to the impact wrench 10A described above with reference to FIGS. 4A-4B. Accordingly, features and elements of the impact wrench 10D corresponding with features and elements of the impact wrench 10A are given like reference numbers followed by the letter 'D.' In addition, the following description focuses primarily on differences between the impact wrench 10D and the impact wrench 10A.

The impact wrench 10D includes a compact housing 14D with a shorter overall length L3 and a shorter overall height H3 than the length L and height H of the impact wrench 10A, respectively. In the illustrated embodiment, the length L3 is about 20.8 inches, and the height H3 is about 9.1 inches. The battery receptacle 38D of the impact wrench 10D is located on the back side of the first handle 26D, such that the battery pack 34D is insertable and removable from the battery receptacle 38D in a direction perpendicular to the longitudinal axis 16D. This arrangement places the center of mass of the battery pack 34D generally in line with the longitudinal axis 16D, improving the balance of the impact wrench 10D.

Figure 8B:
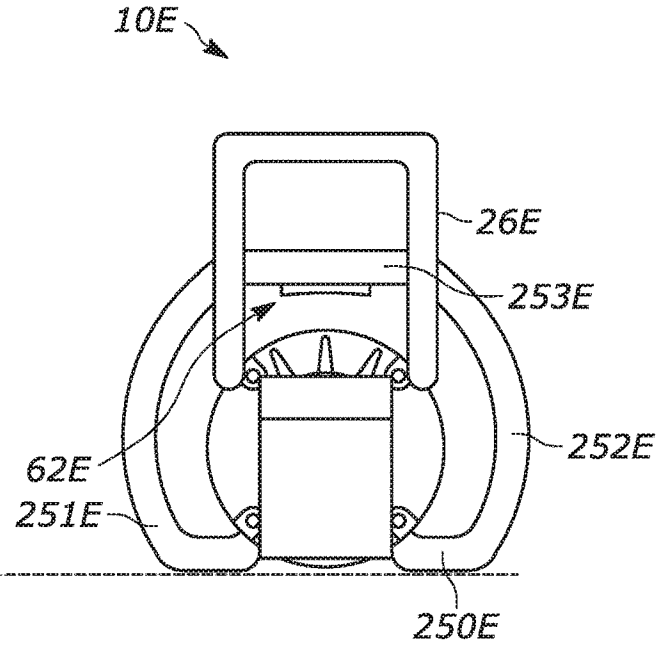
FIG. 8B is a rear view of the impact wrench of FIG. 8A.
Figure 8A:
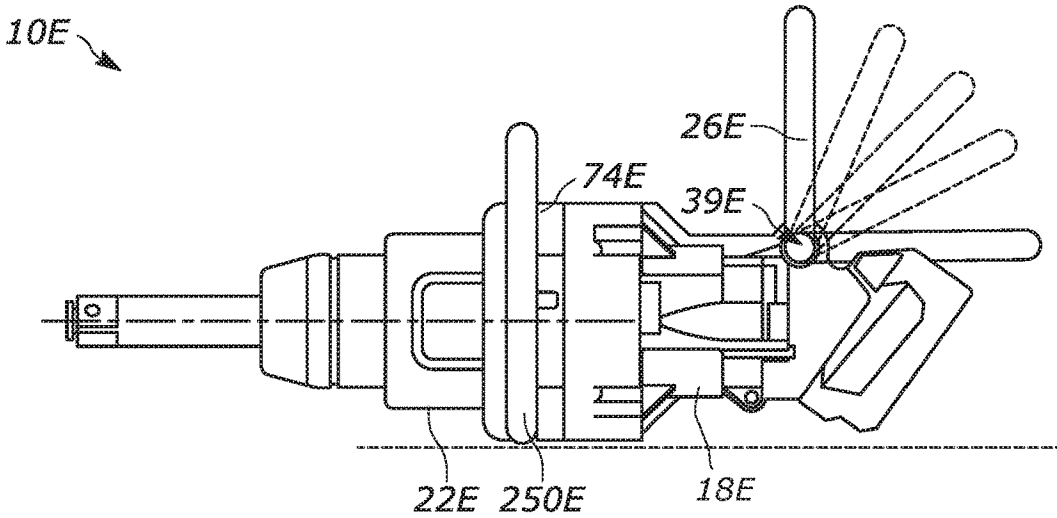
FIG. 8A is a side view of an impact wrench according to another embodiment.

FIGS. 8A-8B illustrate an impact wrench 10E according to another embodiment. The impact wrench 10E is similar to the impact wrench 10A described above with reference to FIGS. 4A-4B. Accordingly, features and elements of the impact wrench 10E corresponding with features and elements of the impact wrench 10A are given like reference numbers followed by the letter 'E.' In addition, the following description focuses primarily on differences between the impact wrench 10E and the impact wrench 10A.

The first handle 26E of the impact wrench 10E is generally U-shaped and is pivotally coupled to the motor housing portion 18E. The first handle 26E is adjustable between a variety of different orientations (FIG. 8A). In some embodiments, the first handle 26E includes an adjustment mechanism 39E, such as a pair of ratchet plates or a detent and a plurality of recesses, to allow the first handle 26E to be retained in one of a plurality of predetermined angular positions.

The second handle 250E of the impact wrench 10E is configured as a bail handle with ends coupled to the underside of the front housing portion 22E, proximate the gear case 74E. Referring to FIG. 8B, the second handle 250E includes curved gripping portions 251E, 252E and a flat portion 253E centered between the curved gripping portions 251E, 252E and extending laterally over the top of the impact wrench 10E. The trigger switch 62E is provided on the flat portion 253E. In the illustrated embodiment, the trigger switch 62E is a rocker switch that can be activated by pivoting the switch 62E in either direction, which may facilitate ambidextrous operation of the impact wrench 10E.

Figure 9A:
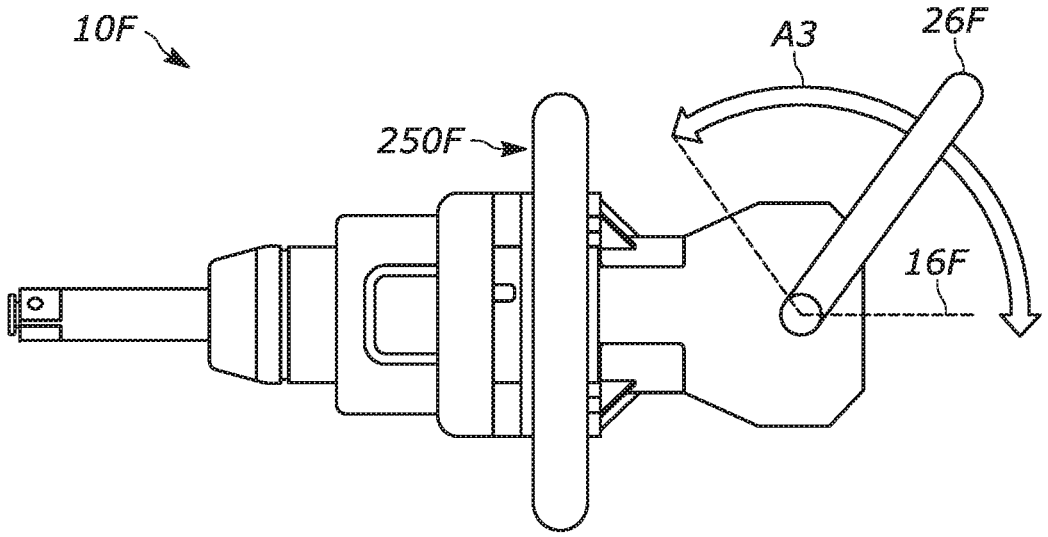
FIG. 9A is a side view of an impact wrench according to another embodiment.
Figure 9B:
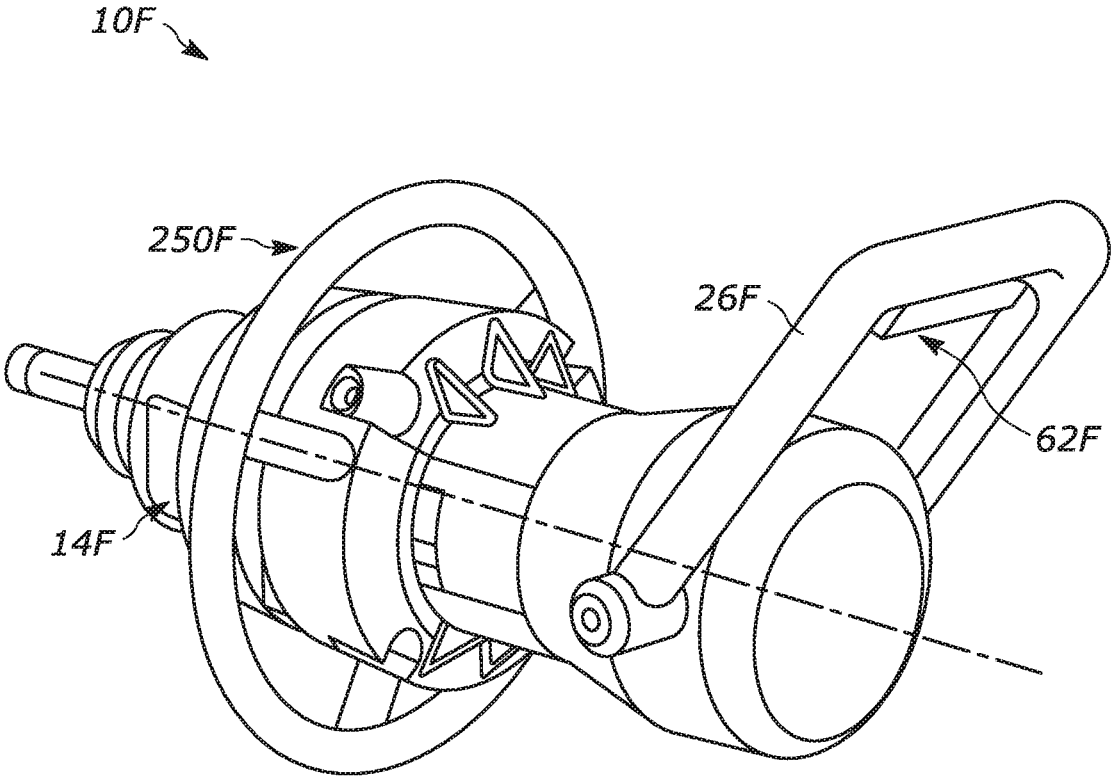
FIG. 9B is a perspective view of the impact wrench of FIG. 9A.

FIGS. 9A-9B illustrate an impact wrench 10F according to another embodiment. The impact wrench 10F is similar to the impact wrench 10E described above with reference to FIGS. 8A-8B. Accordingly, features and elements of the impact wrench 10F corresponding with features and elements of the impact wrench 10E are given like reference numbers followed by the letter 'F.' In addition, the following description focuses primarily on differences between the impact wrench 10F and the impact wrench 10E.

The trigger switch 62F of the impact wrench 10F is located on the pivotably adjustable first handle 26F, rather than on the second handle 250F (FIG. 9B). The trigger switch 62F is configured as a wide pushbutton able to accommodate up to all four fingers when the operator grasps the first handle 26F. The first handle 26F may be pivotably adjustable from an orientation of zero degrees, in which the first handle 26F extends parallel to the longitudinal axis 16F, to an angle A3 of up to 100 degrees relative to the longitudinal axis 16F (FIG. 9A).

With reference to FIG. 9B, the second handle 250F is ring shaped and completely surrounds (i.e. extends 360 degrees around) the housing 14F of the impact wrench 10F. This permits the operator to grip and the second handle 250F at any point around its circumference, allowing the impact wrench 10F to be handled in a wide variety of different orientations.

Figure 10A:
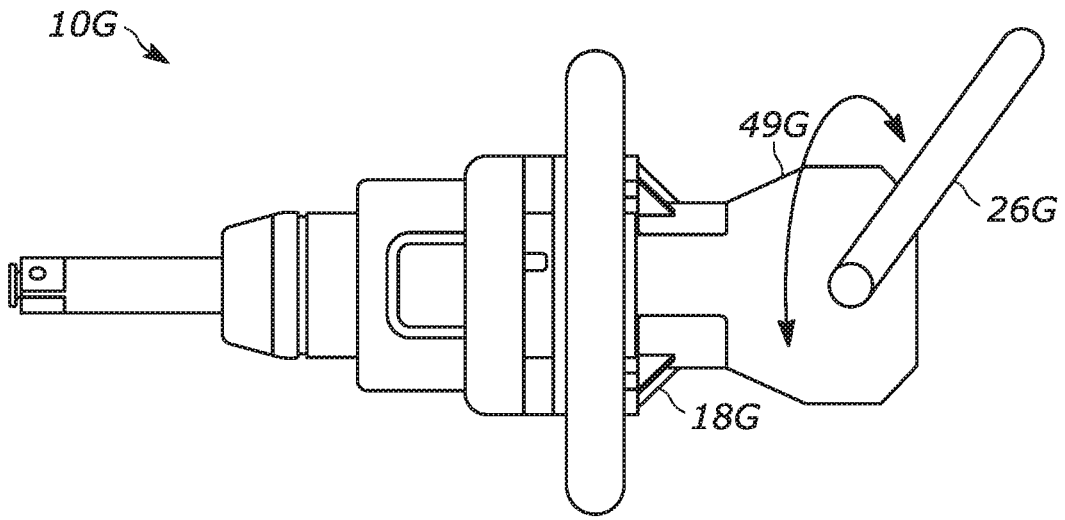
FIG. 10A is a side view of an impact wrench according to another embodiment.
Figure 10B:
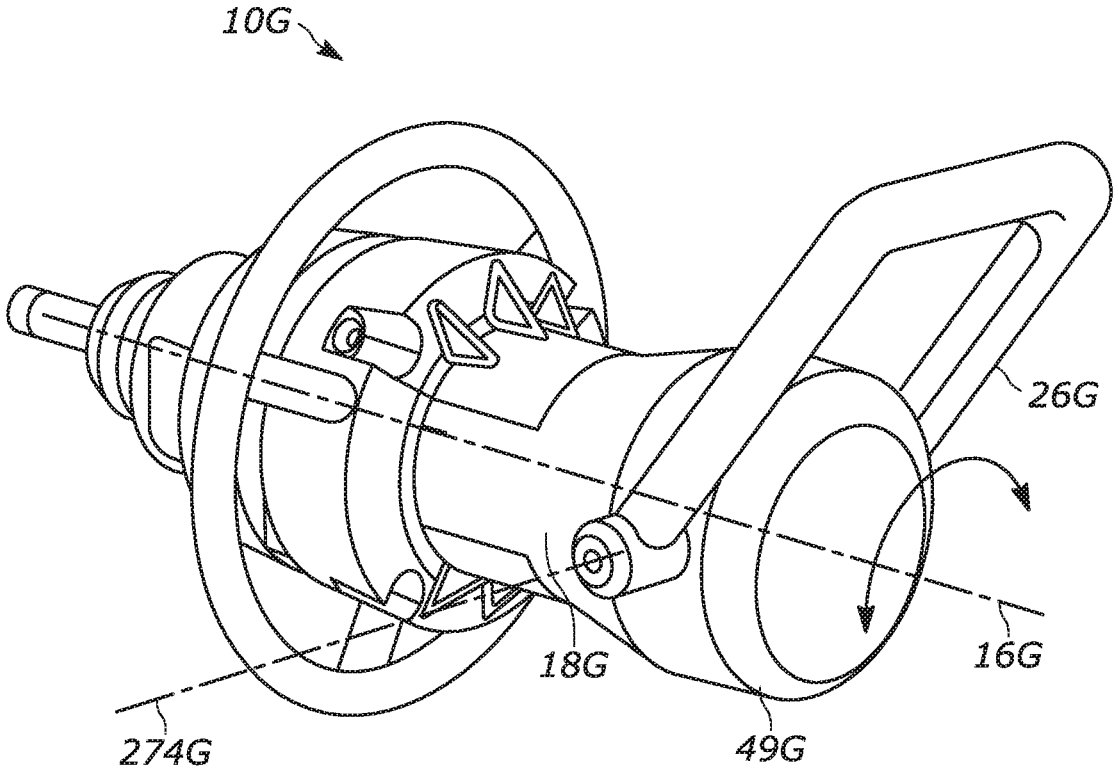
FIG. 10B is a perspective view of the impact wrench of FIG. 10A.

FIGS. 10A-10B illustrate an impact wrench 10G according to another embodiment. The impact wrench 10G is similar to the impact wrench 10F described above with reference to FIGS. 9A-9B. Accordingly, features and elements of the impact wrench 10G corresponding with features and elements of the impact wrench 10F are given like reference numbers followed by the letter 'G.' In addition, the following description focuses primarily on differences between the impact wrench 10G and the impact wrench 10F.

The motor housing portion 18G of the impact wrench 10G includes a rotatable rear cap 49G that is selectively rotatable about the longitudinal axis 16G (FIG. 10B). The first handle 26G is pivotally coupled to the rear cap 49G. As such, the first handle 26G is rotatable to different orientations about the longitudinal axis 16G by rotating the rear cap 49G, and rotatable to different orientations about a handle pivot axis 274G that is orthogonal to the longitudinal axis 16G.

Figure 11A:
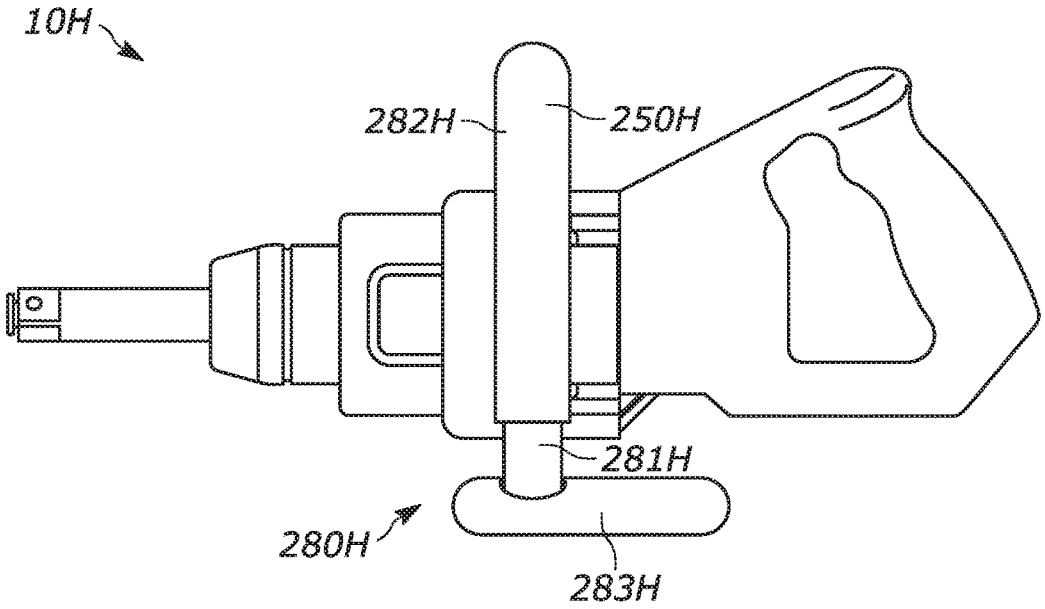
FIG. 11A is a side view of an impact wrench according to another embodiment.
Figure 11B:
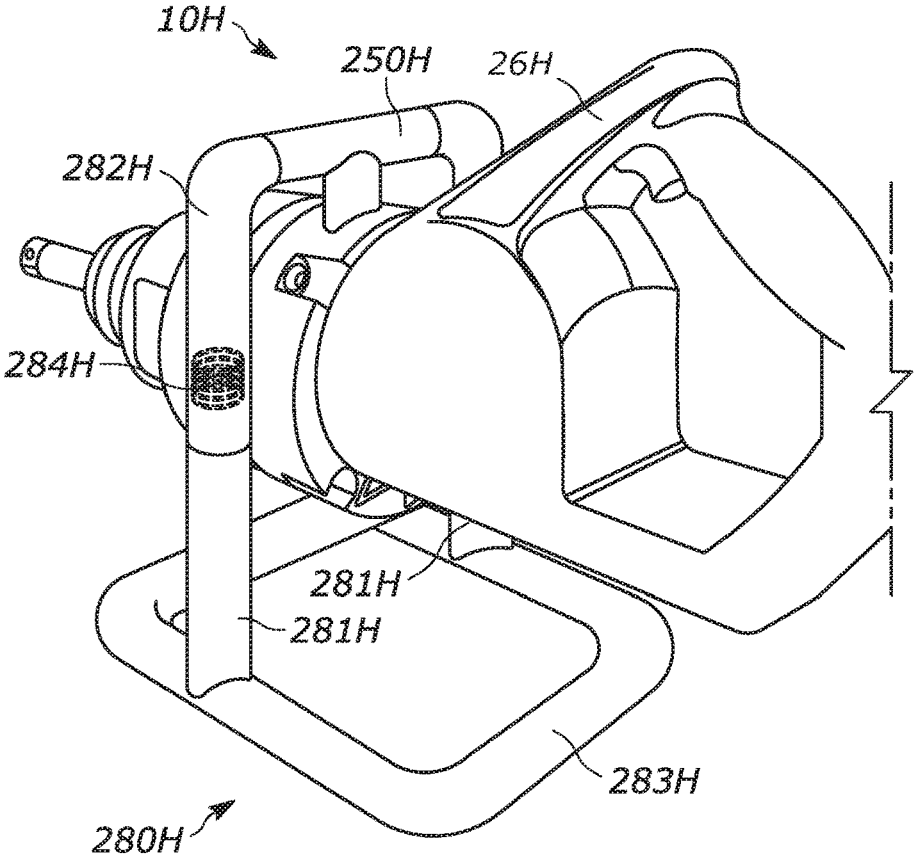
FIG. 11B is a perspective view of the impact wrench of FIG. 11A.

FIGS. 11A-11B illustrate an impact wrench 10H according to another embodiment. The impact wrench 10H is similar to the impact wrench 10 described above with reference to FIGS. 1-3B. Accordingly, features and elements of the impact wrench 10H corresponding with features and elements of the impact wrench 10 are given like reference numbers followed by the letter 'H.' In addition, the following description focuses primarily on differences between the impact wrench 10H and the impact wrench 10.

The impact wrench 10H includes a support stand 280H coupled to the second handle 250H. In some embodiments, the support stand 280H may be removable from the second handle 250H to provide a more compact overall size when the support stand 280H is not needed. The support stand includes a pair of legs 281H that are slidably received within downwardly-extending legs 282H of the second handle 250H. Thus, the support stand 280H can telescope in and out of the second handle 250H. The support stand 280H further includes a base 283H coupled to the legs 281H for supporting the impact wrench 10H on a surface (e.g., the ground, a table, etc.). In the illustrated embodiment, a spring 284H is coupled between the support stand legs 281H and the legs 282 of the second handle 250H (FIG. 11B). The spring 284H may advantageously provide vibration absorption and impact protection.

Figure 12A:
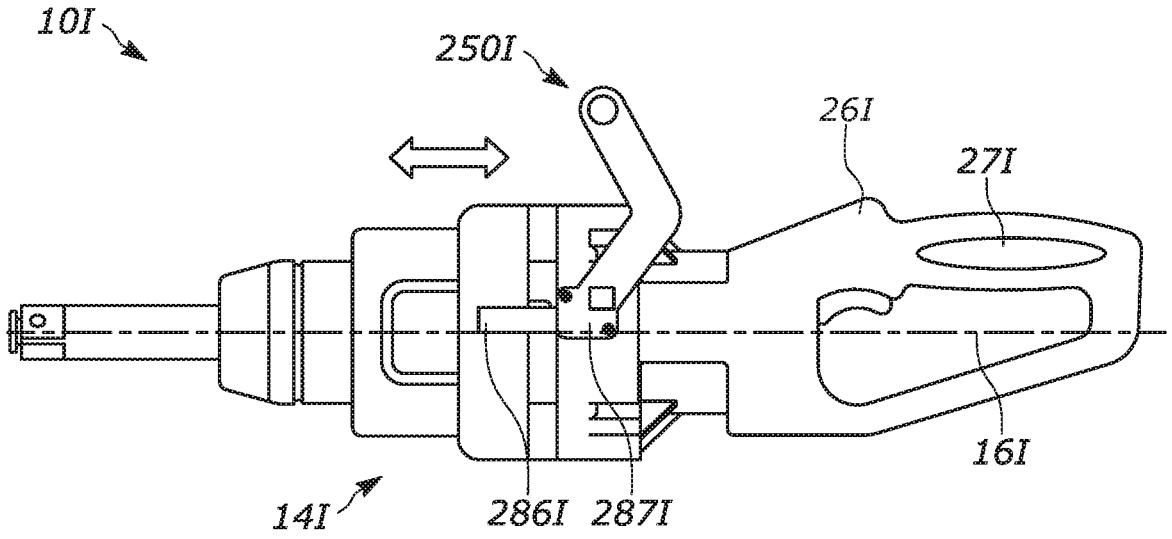
FIG. 12A is a side view of an impact wrench according to another embodiment.
Figure 12B:
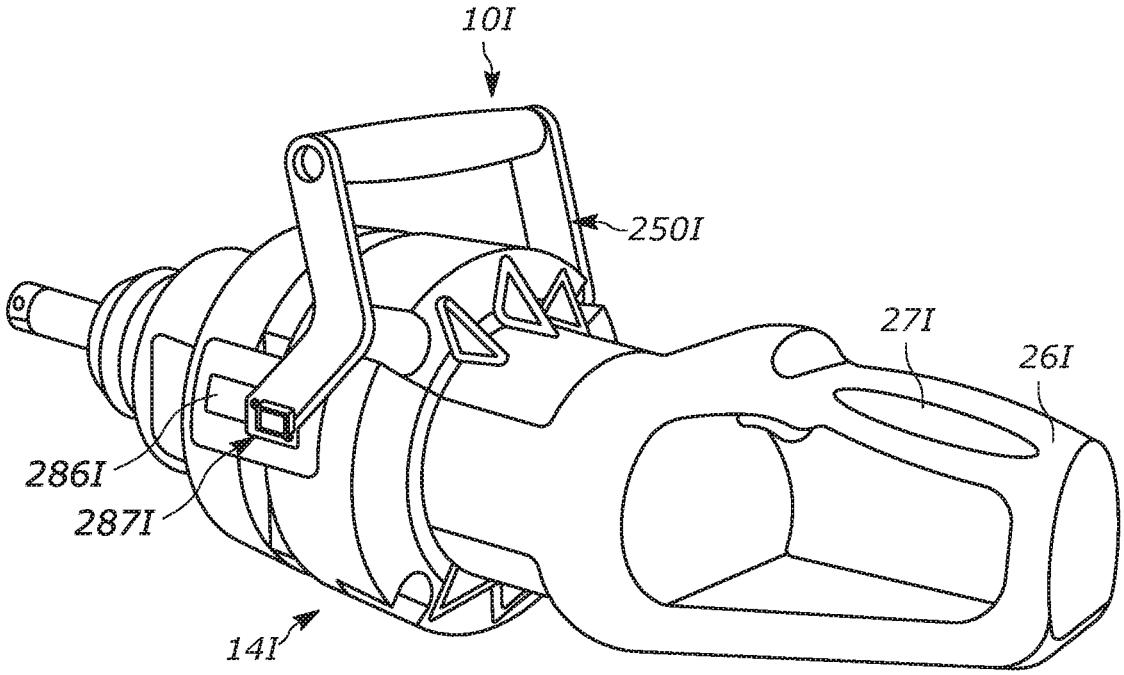
FIG. 12B is a perspective view of the impact wrench of FIG. 12A.

FIGS. 12A-12B illustrate an impact wrench 10I according to another embodiment. The impact wrench 10I is similar to the impact wrench 10 described above with reference to FIGS. 1-3B. Accordingly, features and elements of the impact wrench 10I corresponding with features and elements of the impact wrench 10 are given like reference numbers followed by the letter 'I.' In addition, the following description focuses primarily on differences between the impact wrench 10I and the impact wrench 10.

The first handle 26I of the impact wrench 10I has a grip portion 27I that extends generally parallel to the longitudinal axis 16I (FIG. 12A). The second handle 250I of the impact wrench 10I is coupled to tracks 286I formed in opposite lateral sides of the housing 14I. An adjustment mechanism 287I, which is a push-button locking mechanism in the illustrated embodiment, is provided to selectively retain the second handle 250I at a particular position along the tracks 286I. Thus, the second handle 250I is adjustable along the tracks 286I to vary a position of the second handle 250I along the longitudinal axis 16I.

Figure 13:
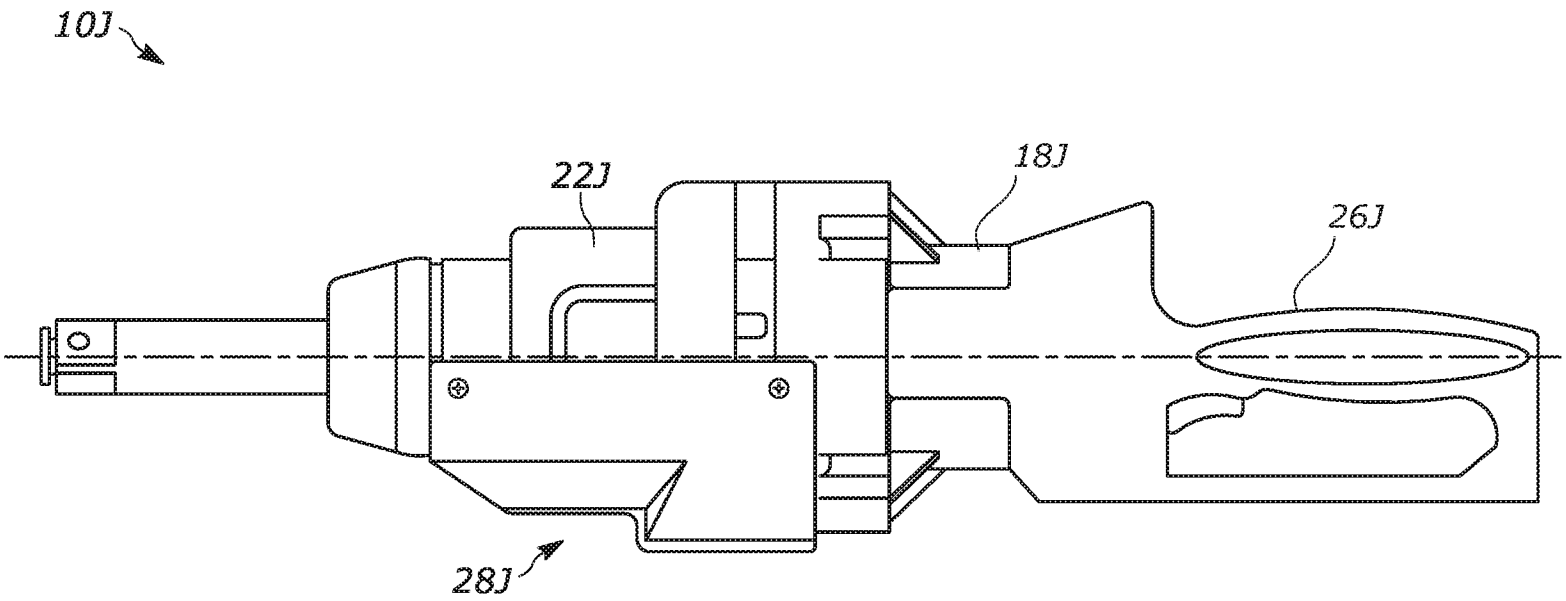
FIG. 13 is a side view of an impact wrench according to another embodiment.

FIG. 13 illustrates an impact wrench 10J according to another embodiment. The impact wrench 10J is similar to the impact wrench 10I described above with reference to FIGS. 12A-12B. Accordingly, features and elements of the impact wrench 10J corresponding with features and elements of the impact wrench 10I are given like reference numbers followed by the letter 'J.' In addition, the following description focuses primarily on differences between the impact wrench 10J and the impact wrench 10I.

The impact wrench 10J does not include a second handle. Instead, an elastomeric boot 28J is provided on the underside of the front housing portion 22J. In some embodiments, the elastomeric boot 28J may be overmolded on the front housing portion 22J. In other embodiments, the elastomeric boot 28J may be removable from the front housing portion 22J. The elastomeric boot 28J provides a comfortable location for an operator to support the front of the impact wrench 10J, and may provide protection from drops, etc.

Figure 14A:
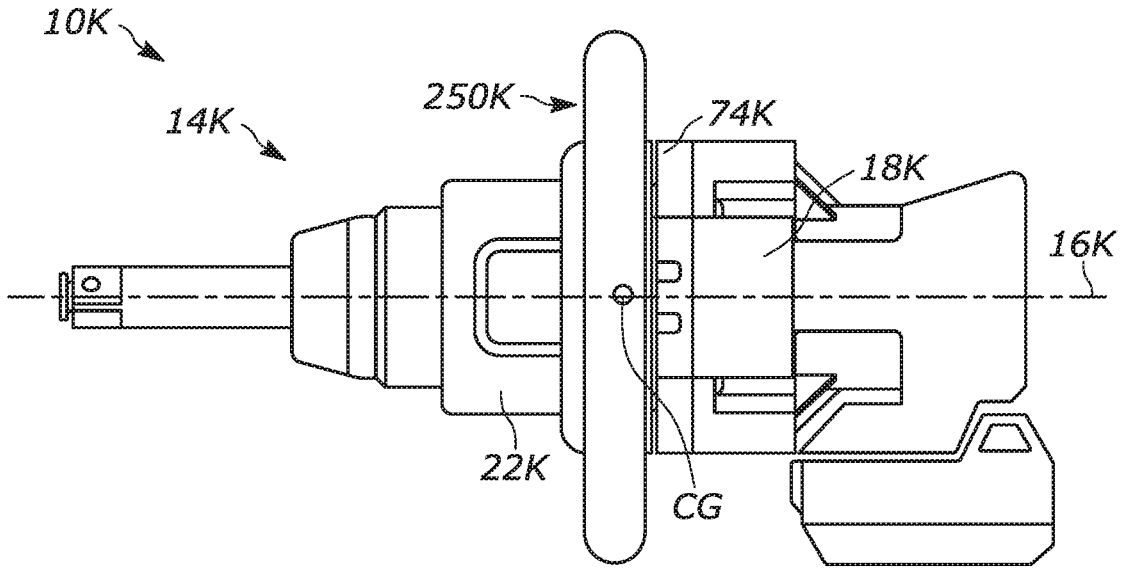
FIG. 14A is a side view of an impact wrench according to another embodiment.
Figure 14B:
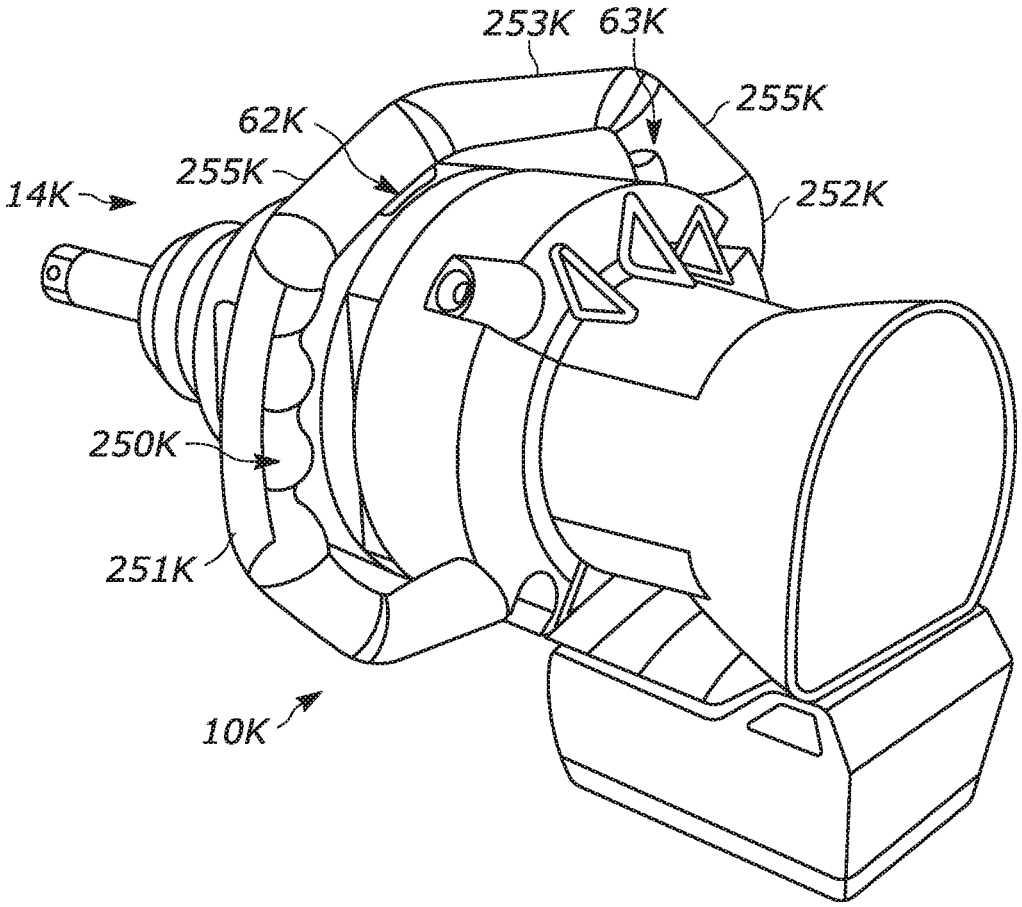
FIG. 14B is a perspective view of the impact wrench of FIG. 14A.

FIGS. 14A-14B illustrate an impact wrench 10K according to another embodiment. The impact wrench 10K is similar to the impact wrench 10 described above with reference to FIGS. 1-3B. Accordingly, features and elements of the impact wrench 10K corresponding with features and elements of the impact wrench 10 are given like reference numbers followed by the letter 'K.' In addition, the following description focuses primarily on differences between the impact wrench 10K and the impact wrench 10.

The impact wrench 10K include a compact housing 14K and a single bail handle 250K that substantially surrounds the housing 14K. The handle 250K may be coupled to the front housing portion 22K, the gear case 74K, or the motor housing portion 18K (e.g., via fasteners), but is preferably positioned to overlap the center of gravity CG of the impact wrench in a direction along the longitudinal axis 16K (FIG. 14A). As such, the impact wrench 10K is balanced at the handle 250K.

The illustrated handle 250K includes curved gripping portions 251K, 252K and a flat portion 253K centered between the curved gripping portions 251K, 252K and extending laterally over the top of the impact wrench 10E (FIG. 14B). The illustrated gripping portions 251K, 252K are provided with undulations that fit between an operator's fingers to enhance grip and comfort. The handle 250K further includes transition portions 255K disposed between the respective gripping portions 251K, 252K and the flat portion 253K. First and second trigger switches 62K, 63K are positioned on the respective transition portions 255K. Providing two trigger switches 62K, 63K on the handle 250K facilitates ambidextrous operation of the impact wrench 10K.

Figure 15A:
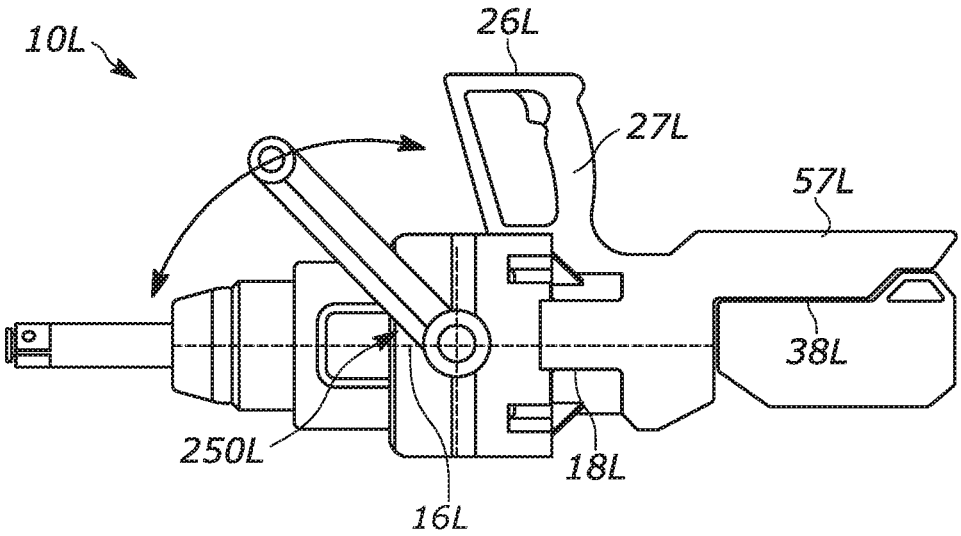
FIG. 15A is a side view of an impact wrench according to another embodiment.
Figure 15B:
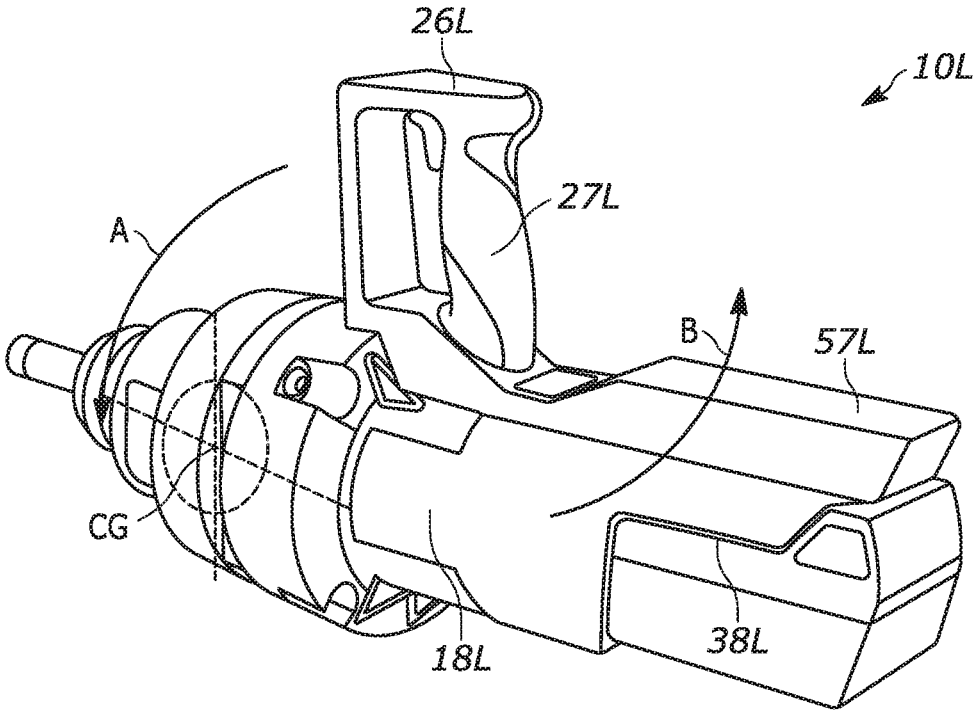
FIG. 15B is a perspective view of the impact wrench of FIG. 15A.

FIGS. 15A-15B illustrate an impact wrench 10L according to another embodiment. The impact wrench 10L is similar to the impact wrench 10 described above with reference to FIGS. 1-3B. Accordingly, features and elements of the impact wrench 10L corresponding with features and elements of the impact wrench 10 are given like reference numbers followed by the letter 'L.' In addition, the following description focuses primarily on differences between the impact wrench 10L and the impact wrench 10.

The first handle 26L of the impact wrench 10L extends upwardly from the top side of the motor housing portion 18L and includes a grip portion 27L oriented generally perpendicular to the longitudinal axis 16L (FIG. 15A). A forearm support 57L extends along the top side of the motor housing portion 18L rearward of the first handle 26L. The battery receptacle 38L is located underneath the forearm support 57L adjacent the rear of the motor housing portion 18L.

The first handle 26L is positioned relative to the center of gravity CG of the impact wrench 10L such that the weight the impact wrench 10L forward of the handle 26L tends to pivot the front end downward, in the direction of arrow A, and the rear end upward, in the direction of arrow B (FIG. 15B). The forearm support 57L is engageable with the operator's forearm as the operator grips the first handle 26L to counteract this pivoting motion. The forearm support 57L may be padded and/or include an elastomeric overmold for operator comfort.

In some embodiments, the impact wrench 10L may further include an adjustable second handle 250L to provide additional control and stability for the front of the impact wrench 10L (FIG. 15A).

Figure 16A:
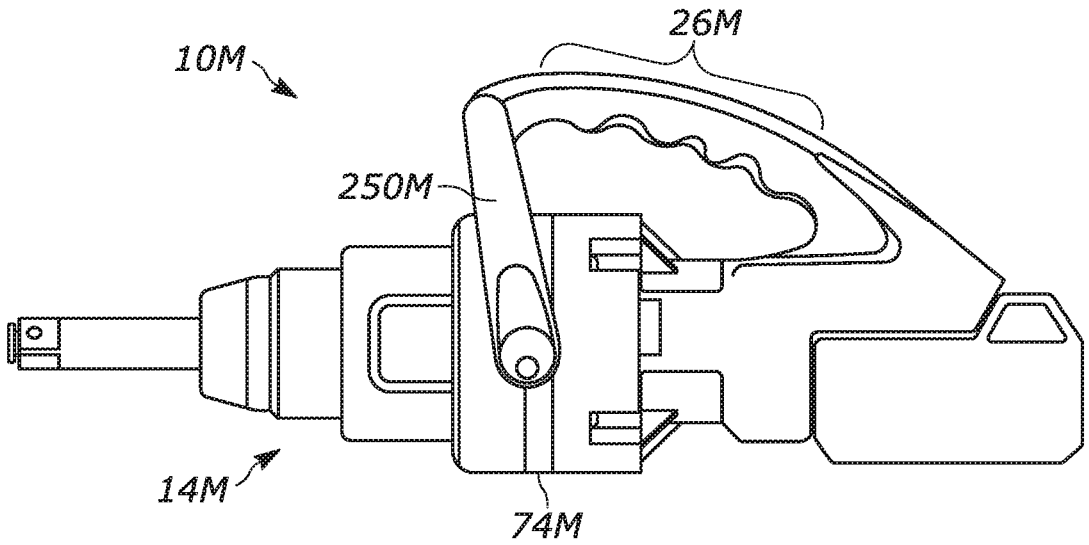
FIG. 16A is a side view an impact wrench according to another embodiment.
Figure 16B:
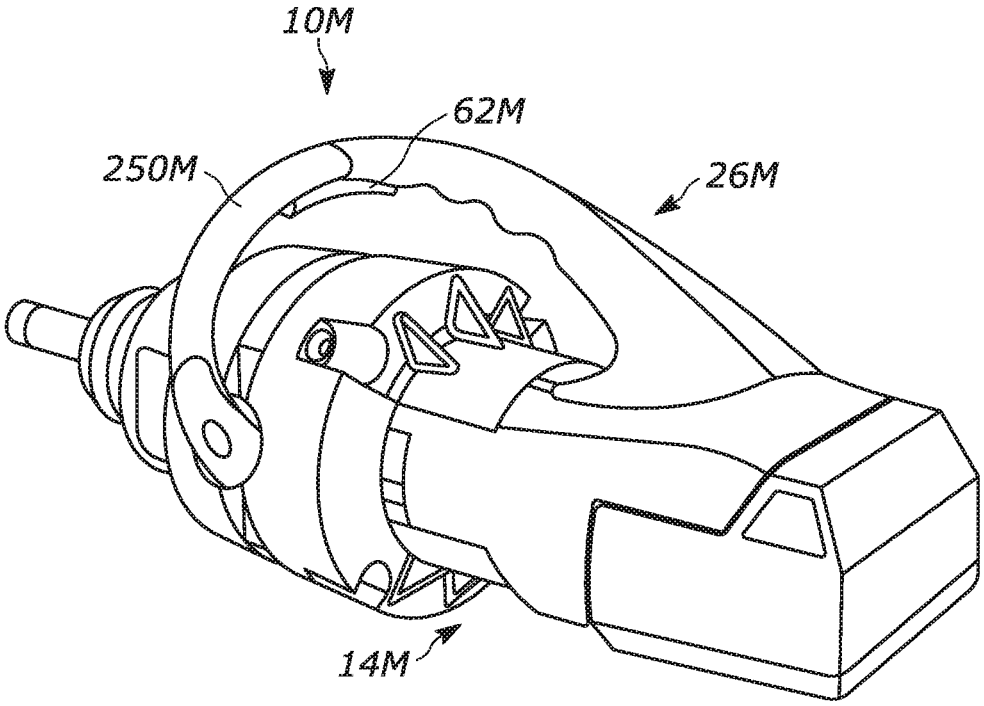
FIG. 16B is a perspective view of the impact wrench of FIG. 16A.

FIGS. 16A-16B illustrate an impact wrench 10M according to another embodiment. The impact wrench 10M is similar to the impact wrench 10 described above with reference to FIGS. 1-3B. Accordingly, features and elements of the impact wrench 10M corresponding with features and elements of the impact wrench 10 are given like reference numbers followed by the letter 'M.' In addition, the following description focuses primarily on differences between the impact wrench 10M and the impact wrench 10.

The second handle 250M of the impact wrench 10M is shaped as a curved bail handle and is coupled to the gear case 74M. The first handle 26M extends from a rear end of the housing 14M to the center of the second handle 250M. The first handle 26M and the second handle 250M of the impact wrench 10M thus are interconnected to form a combined handle structure, offering a variety of different gripping points and, in some embodiments, providing additional structural support to the housing 14M. In the illustrated embodiment, the trigger switch 62M is configured as a rocker switch and is positioned centrally on the second handle 250M adjacent the intersection between the second handle 250M and the first handle 26M (FIG. 16B). The trigger switch 62M can be actuated on either side to facilitate ambidextrous operation of the impact wrench 10M.

Figure 17:
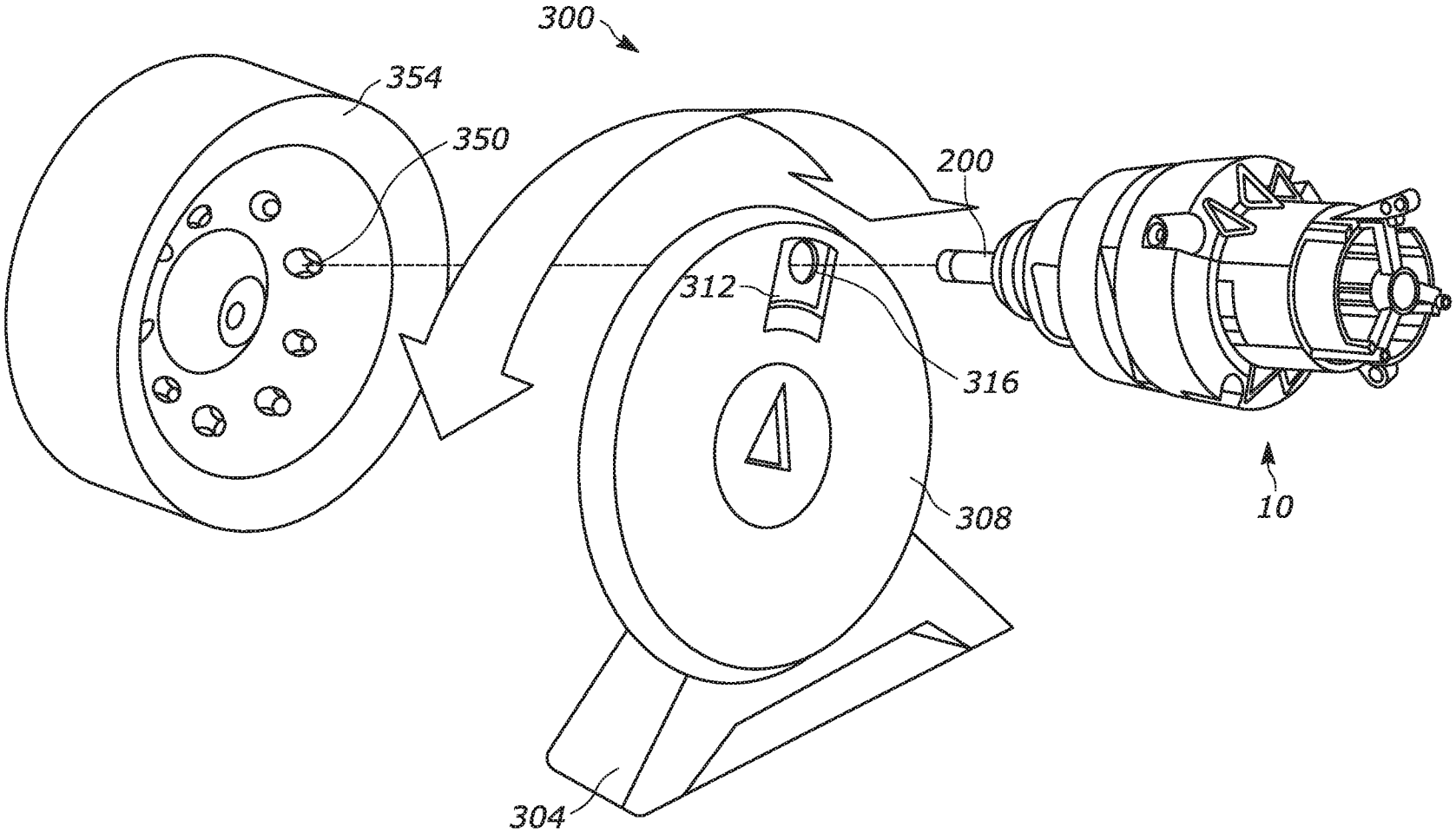
FIG. 17 illustrates an impact wrench according to another embodiment.

FIG. 17 illustrates a stand 300 that is usable with an impact wrench, such as any of the impact wrenches 10 or 10A-10M described and illustrated in FIGS. 1-16. The stand 300 includes a base 304, a rotatable drum 308 coupled to the base 304, and an anvil guide 312 coupled to the drum 308. The anvil guide 312 includes a guide bore 316 configured to receive the anvil 200 to guide the anvil 200 during a fastening operation. The anvil guide 312 is slidable in a radial direction of the drum 308 to vary a radial position of the guide bore 316.

The stand 300 may be particularly advantageous when used to tighten or loosen fasteners 350 arranged in a circular pattern on a workpiece 354, such as lug nuts on a wheel, nuts and bolts arranged about a circular flange, and the like. In operation, the stand 300 is positioned adjacent the workpiece 354 with the center of the drum 308 aligned concentrically with the center of the fastener pattern. The anvil guide 312 is then adjusted to a position corresponding with the radial position of each fastener 350. The anvil 200 of the impact wrench 10 is inserted through the guide bore 316 to tighten or loosen a particular fastener 350. When completed, the drum 308 is rotated until the guide bore 316 aligns with the next fastener 350, and the process is repeated. The stand 300 may support at least a portion of the weight of the impact wrench 10 to reduce operator fatigue, and the stand 300 facilitates quick and accurate fastening operations when working with circular fastener patterns.

Although the invention has been described in detail with reference to certain preferred embodiments, variations and modifications exist within the scope and spirit of one or more independent aspects of the invention as described.

Various features of the invention are set forth in the following claims.

What is claimed is:

1. An impact tool comprising:

a housing extending along a longitudinal axis, the housing including a motor housing portion, a first handle extending from the motor housing portion, and a front housing coupled to the motor housing portion opposite the first handle;

a motor supported within the motor housing portion;

an anvil extending from the front housing;

an impact mechanism supported within the front housing, the impact mechanism driven by the motor to deliver incremental rotational impacts to the anvil;

a battery receptacle configured to receive a removable battery pack;

a trigger switch actuatable to energize the motor; and an auxiliary handle assembly including a mount coupled to the housing, the mount including a flexible band clamp that includes a ring portion, a first tab, and a second tab spaced from the first tab, an auxiliary handle coupled to the mount and spaced from the first handle, and an adjustment mechanism, wherein loosening the adjustment mechanism permits rotation of the auxiliary handle assembly about the longitudinal axis relative to the housing, and wherein tightening the adjustment mechanism decreases a spacing between the first tab and the second tab to reduce a diameter of the ring portion and secures the auxiliary handle assembly in a selected rotational position.

2. The impact tool of claim 1, wherein the ring portion includes a plurality of detents configured to engage a plurality of recesses on the front housing.

3. The impact tool of claim 2, wherein the plurality of detents is engageable with the plurality of recesses to provide tactile feedback when the mount is rotated about the longitudinal axis relative to the housing.

4. The impact tool of claim 1, wherein the adjustment mechanism includes an actuator, a first clamp member biased into engagement with the first tab, and a second clamp member biased into engagement with the second tab.

5. The impact tool of claim 4, wherein the adjustment mechanism includes a rod extending along a second axis orthogonal to the longitudinal axis, and wherein the rod extends through the first clamp member, the first tab, the second clamp member, and the second tab.

6. The impact tool of claim 5, wherein the rod includes a threaded portion and a head opposite the threaded portion, wherein the adjustment mechanism includes a seat opposite the actuator, wherein the threaded portion is threadably coupled to the actuator, and wherein the head is fixed to the seat.

7. The impact tool of claim 6, wherein the adjustment mechanism includes a first biasing member extending between the actuator and the first clamp member and a second biasing member extending between the head and the second clamp member.

8. The impact tool of claim 7, wherein the adjustment mechanism includes a third biasing member extending between the first tab and the second tab.

9. The impact tool of claim 1, wherein loosening the adjustment mechanism permits rotation of the auxiliary handle relative to the mount about a second axis orthogonal to the longitudinal axis.

10. An impact tool comprising:

a housing extending along a longitudinal axis, the housing including a motor housing portion and a front housing coupled to the motor housing portion;

a motor supported within the motor housing portion;

an anvil extending from the front housing;

an impact mechanism supported within the front housing, the impact mechanism driven by the motor to deliver incremental rotational impacts to the anvil;

a battery receptacle configured to receive a removable battery pack;

a trigger switch actuatable to energize the motor;

a first handle extending from the motor housing portion;

a second handle coupled to the front housing, the second handle including a grip portion that extends along a grip axis; and an adjustment mechanism configured to adjust a position of the second handle relative to the front housing, the adjustment mechanism including an actuator that is rotatable about an adjustment axis, wherein the adjustment axis and the grip axis are substantially parallel and offset from one another.

11. The impact tool of claim 10, wherein the second handle substantially surrounds the front housing.

12. The impact tool of claim 10, wherein the trigger switch is located on the second handle.

13. The impact tool of claim 10, wherein the trigger switch includes a rocker switch.

14. The impact tool of claim 10, wherein the trigger switch is located on the first handle.

15. The impact tool of claim 10, wherein at least one of the first handle or the second handle is adjustable.

16. The impact tool of claim 15, wherein the second handle is slidable along the housing in a direction parallel to the longitudinal axis.

17. The impact tool of claim 15, wherein the second handle is pivotable about a handle axis orthogonal to the longitudinal axis.

18. The impact tool of claim 15, wherein the second handle is rotatable about the longitudinal axis.

19. The impact tool of claim 10, further comprising a stand coupled to the second handle.

20. The impact tool of claim 10, wherein the first handle includes a first grip portion and a second grip portion, wherein the trigger switch is a first trigger switch located on the first grip portion, wherein the impact tool further comprises a second trigger switch located on the second grip portion, and wherein the second trigger switch is actuatable to electrically connect the battery pack to the motor to energize the motor.

21. The impact tool of claim 10, wherein the first handle includes a first grip portion extending along a first grip axis, and wherein the first grip axis is inclined at an angled between 35 degrees and 45 degrees relative to the longitudinal axis.

22. The impact tool of claim 10, wherein at least one of the first handle or the second handle is rotatable relative to the housing about the longitudinal axis, and wherein at least one of the first handle or the second handle is pivotable relative to the housing about a handle axis orthogonal to the longitudinal axis.

23. An impact tool comprising:

a housing extending along a longitudinal axis, the housing including a motor housing portion and a front housing coupled to the motor housing portion;

a motor supported within the motor housing portion;

an anvil extending from the front housing;

an impact mechanism supported within the front housing, the impact mechanism driven by the motor to deliver incremental rotational impacts to the anvil;

a battery receptacle configured to receive a removable battery pack;

a trigger switch actuatable to energize the motor;

a first handle extending from the motor housing portion; and an auxiliary handle assembly including a mount coupled to the housing, an auxiliary handle coupled to the mount and spaced from the first handle, the auxiliary handle including a grip portion, and an adjustment mechanism, wherein the auxiliary handle is rotatable relative to the housing about the longitudinal axis, wherein the auxiliary handle is pivotable relative to the housing about a handle axis orthogonal to the longitudinal axis, and wherein pivoting the auxiliary handle about the handle axis changes a distance between the grip portion of the auxiliary handle and the longitudinal axis.

24. The impact tool of claim 23, wherein the adjustment mechanism includes an actuator rotatable about the handle axis in a loosening direction and a tightening direction.

25. The impact tool of claim 24, wherein rotation of the actuator in the loosening direction permits the auxiliary handle assembly to be rotated relative to the housing about the longitudinal axis between a plurality of rotational positions, and wherein the auxiliary handle assembly is securable in one of the plurality of rotational positions by rotating the actuator in the tightening direction.

26. The impact tool of claim 24, wherein rotation of the actuator in the loosening direction permits the auxiliary handle to be pivoted relative to the mount about the handle axis between a plurality of rotational positions, and wherein the auxiliary handle is securable in one of the plurality of rotational positions by rotating the actuator in the tightening direction.

27. The impact tool of claim 23, wherein the mount includes a band clamp surrounding the front housing, and wherein the band clamp includes a ring portion having a plurality of detents configured to engage a plurality of recesses on the front housing.

28. The impact tool of claim 27, wherein the band clamp includes first and second tabs extending from the ring portion, and wherein the adjustment mechanism includes a threaded rod extending through the first and second tabs.

* * * * *